US009681526B2

(12) United States Patent
Ostrovsky et al.

(10) Patent No.: US 9,681,526 B2
(45) Date of Patent: Jun. 13, 2017

(54) POWER EFFICIENT LINE SYNCHRONIZED DIMMER

(71) Applicant: Leviton Manufacturing Co., Inc., Melville, NY (US)

(72) Inventors: Michael Ostrovsky, Brooklyn, NY (US); Ozgur Keser, Ronkonkoma, NY (US)

(73) Assignee: Leviton Manufacturing Co., Inc., Melville, NY (US)

( * ) Notice: Subject to any disclaimer, the term of this patent is extended or adjusted under 35 U.S.C. 154(b) by 191 days.

(21) Appl. No.: 14/302,255

(22) Filed: Jun. 11, 2014

(65) Prior Publication Data

US 2015/0366029 A1 Dec. 17, 2015

(51) Int. Cl.
*H05B 37/02* (2006.01)
*H05B 39/08* (2006.01)

(52) U.S. Cl.
CPC ..... *H05B 39/08* (2013.01)

(58) Field of Classification Search
None
See application file for complete search history.

(56) References Cited

U.S. PATENT DOCUMENTS 3,218,511 A 11/1965 Rosenbaum
3,678,291 A 7/1972 Coe
3,935,505 A 1/1976 Spiteri
4,010,386 A 3/1977 Rossell
4,096,884 A 6/1978 Horowitz
4,296,449 A 10/1981 Eichelberger
4,365,164 A 12/1982 Sibley
4,396,869 A 8/1983 Rosenbaum et al.
4,427,863 A 1/1984 Fujita
4,581,705 A 4/1986 Gilker et al.
4,651,060 A 3/1987 Clark
4,675,987 A 6/1987 Minks et al.
4,739,351 A 4/1988 Feldman
4,829,457 A 5/1989 Russo et al.
4,835,502 A 5/1989 Minnette
5,001,386 A 3/1991 Sullivan et al.
5,004,957 A 4/1991 Cunningham
5,041,763 A 8/1991 Sullivan et al.
(Continued)

FOREIGN PATENT DOCUMENTS

EP 0039869 A1 5/1981
EP 1965611 A1 3/2008
(Continued)

OTHER PUBLICATIONS

Leviton, Technical Application Note, Programming Guide for Vizia + Dimmers and Quiet Fan Speed Control, 2008, 4 pages.
(Continued)

*Primary Examiner* — Alexander H Taningco
*Assistant Examiner* — Nelson Correa
(74) *Attorney, Agent, or Firm* — Heslin Rothenberg Farley & Mesiti P.C.

(57) ABSTRACT

There is set forth herein a dimmer circuit for controlling delivery of input line voltage to a load. The dimmer circuit can include a switch coupling an input line voltage terminal to a load terminal. The dimmer circuit can be operative to provide one or more switch firing control scheme for latching the switch.

8 Claims, 10 Drawing Sheets

(56) References Cited

U.S. PATENT DOCUMENTS 5,144,205 A 9/1992 Motto et al.
5,173,643 A 12/1992 Sullivan et al.
5,258,889 A 11/1993 Belanger, Jr.
5,327,047 A 7/1994 Gershen
5,335,135 A 8/1994 Kinney
5,336,979 A 8/1994 Watson et al.
5,338,908 A 8/1994 Rahman et al.
5,359,486 A 10/1994 Crane et al.
5,619,081 A 4/1997 Gershen et al.
5,629,607 A * 5/1997 Callahan ..... H02M 1/44 323/237
5,644,463 A 7/1997 El-Sharkawi et al.
5,684,376 A 11/1997 Neiger et al.
5,686,799 A 11/1997 Moisin et al.
5,719,471 A 2/1998 Kachmarik
5,784,285 A 7/1998 Tamaki et al.
5,798,617 A 8/1998 Moisin
5,814,966 A 9/1998 Williamson et al.
5,841,238 A 11/1998 Van Veldhuizen et al.
5,841,239 A 11/1998 Sullivan et al.
5,847,555 A 12/1998 Lewis
5,854,519 A 12/1998 Gershen et al.
5,864,212 A 1/1999 Sullivan
5,866,993 A 2/1999 Moisin
5,930,104 A 7/1999 Kadah et al.
5,955,841 A 9/1999 Moisin et al.
5,971,597 A 10/1999 Baldwin et al.
5,994,848 A 11/1999 Janczak
6,002,313 A 12/1999 Mrenna et al.
6,011,357 A 1/2000 Gradzki et al.
6,031,750 A 2/2000 Bruccoleri et al.
6,043,611 A 3/2000 Gradzki et al.
6,133,696 A * 10/2000 Tavares ..... H05B 41/3924 315/194
6,153,984 A 11/2000 Fishbein et al.
6,175,195 B1 1/2001 Janczak et al.
6,188,181 B1 2/2001 Sinha et al.
6,198,063 B1 3/2001 Kramer
6,232,855 B1 5/2001 Malingowski et al.
6,233,132 B1 5/2001 Jenski
6,400,098 B1 6/2002 Pun
6,452,344 B1 9/2002 MacAdam et al.
6,456,511 B1 9/2002 Wong
6,497,656 B1 12/2002 Evans et al.
6,512,682 B2 1/2003 Cohen et al.
6,525,542 B2 2/2003 Price
6,577,076 B2 6/2003 Li et al.
6,603,274 B2 8/2003 Ribarich et al.
6,633,823 B2 10/2003 Bartone et al.
6,642,669 B1 11/2003 MacAdam et al.
6,693,395 B2 2/2004 Wilhelm
6,724,157 B2 4/2004 Kazanov et al.
6,727,665 B2 4/2004 Yao
6,741,442 B1 5/2004 McNally et al.
6,768,615 B2 7/2004 Liu
6,897,760 B2 5/2005 Kawata et al.
6,903,554 B2 6/2005 Wilson et al.
6,993,417 B2 1/2006 Osann, Jr.
7,046,716 B1 5/2006 Miao
7,088,059 B2 8/2006 McKinney et al.
7,102,902 B1 * 9/2006 Brown ..... H05B 33/0815 323/905
7,109,665 B2 9/2006 Green
7,110,225 B1 9/2006 Hick
7,132,802 B2 11/2006 Fischer et al.
7,141,891 B2 11/2006 McNally et al.
7,164,238 B2 * 1/2007 Kazanov ..... H05B 37/0227 315/209 R
7,171,461 B2 1/2007 Ewing et al.
7,190,125 B2 3/2007 McDonough et al.
7,196,900 B2 3/2007 Ewing et al.
7,224,125 B2 5/2007 Ribarich
7,236,338 B2 6/2007 Hale et al.
7,242,563 B2 7/2007 Hua et al.
7,288,902 B1 10/2007 Melanson
7,329,996 B2 2/2008 Hsu
7,368,830 B2 5/2008 Cleveland et al.
7,482,756 B2 1/2009 Kesterson
7,538,645 B2 5/2009 Nishi et al.
7,667,408 B2 2/2010 Melanson et al.
7,683,755 B2 3/2010 Ostrovsky et al.
7,759,881 B1 7/2010 Melanson
7,804,255 B2 9/2010 Ostrovsky et al.
7,834,560 B2 11/2010 Ostrovsky et al.
7,852,017 B1 12/2010 Melanson
8,102,683 B2 * 1/2012 Gaknoki ..... H02M 7/217 363/21.13
8,198,829 B2 6/2012 Balasubramanian
8,310,163 B2 * 11/2012 Chen ..... 315/159
8,324,761 B2 12/2012 Elliott et al.
8,350,487 B2 * 1/2013 Thirugnanasambandham ..... H02M 5/2573 315/209 R
8,618,751 B2 12/2013 Ostrovsky et al.
8,664,881 B2 * 3/2014 Newman, Jr. ..... H05B 39/04 315/291
8,664,886 B2 * 3/2014 Ostrovsky ..... H05B 33/0815 315/247
8,716,957 B2 * 5/2014 Melanson ..... H05B 33/0815 315/291
8,729,814 B2 * 5/2014 Salvestrini ..... H05B 39/04 315/224
8,736,193 B2 * 5/2014 Gallo ..... H05B 33/0815 315/291
8,755,944 B2 6/2014 Elliott et al.
9,155,162 B2 * 10/2015 Zotter ..... H05B 33/0815
9,167,662 B2 * 10/2015 King ..... H05B 37/02
9,354,643 B2 * 5/2016 Harel ..... G05F 1/44
2001/0039626 A1 11/2001 Jauert
2002/0140373 A1 10/2002 Ribarich et al.
2003/0062990 A1 4/2003 Schaeffer, Jr. et al.
2003/0112083 A1 6/2003 Atallah et al.
2003/0161279 A1 8/2003 Sherman
2003/0222604 A1 12/2003 Yao
2004/0032222 A1 2/2004 Green
2004/0034484 A1 2/2004 Solomita, Jr. et al.
2004/0054905 A1 3/2004 Reader
2004/0155722 A1 8/2004 Pruchniak
2004/0207337 A1 10/2004 Fischer et al.
2005/0104543 A1 5/2005 Kazanov et al.
2005/0147071 A1 7/2005 Karaoguz et al.
2005/0185669 A1 8/2005 Welborn et al.
2005/0203987 A1 9/2005 Ewing et al.
2005/0243787 A1 11/2005 Hong et al.
2006/0007627 A1 1/2006 Lewis
2006/0023002 A1 2/2006 Hara et al.
2006/0094461 A1 5/2006 Hameed et al.
2006/0259538 A1 11/2006 Ewing et al.
2007/0076340 A1 4/2007 Ewing et al.
2007/0081505 A1 4/2007 Roberts
2007/0112939 A1 5/2007 Wilson et al.
2007/0130243 A1 6/2007 Ewing et al.
2007/0136453 A1 6/2007 Ewing et al.
2007/0140238 A1 6/2007 Ewing et al.
2007/0198748 A1 8/2007 Ametsitsi et al.
2008/0019063 A1 1/2008 Muller et al.
2008/0019068 A1 1/2008 Reynolds et al.
2008/0112097 A1 5/2008 Maharsi et al.
2008/0136261 A1 6/2008 Mierta
2009/0021213 A1 1/2009 Johnson
2009/0027219 A1 1/2009 Ostrovsky et al.
2009/0108765 A1 4/2009 Weightman et al.
2009/0259603 A1 10/2009 Housh et al.
2009/0285189 A1 11/2009 Kim et al.
2010/0090618 A1 4/2010 Veltman
2010/0270948 A1 10/2010 Wang et al.
2011/0062933 A1 3/2011 Tosuntikool et al.
2011/0080111 A1 4/2011 Nuhfer et al.
2011/0109297 A1 5/2011 Tosuntikool
2011/0115460 A1 5/2011 Elliott et al.
2011/0118890 A1 5/2011 Parsons
2011/0121752 A1 5/2011 Newman, Jr. et al.
2011/0199014 A1 8/2011 Pitigoi-Aron et al.

(56) References Cited

U.S. PATENT DOCUMENTS

| | | | |
|---|---|---|---|
| 2011/0199017 | A1 | 8/2011 | Dilger |
| 2011/0204778 | A1 | 8/2011 | Sadwick et al. |
| 2011/0204820 | A1 | 8/2011 | Tikkanen et al. |
| 2011/0285301 | A1 | 11/2011 | Kuang et al. |
| 2012/0033471 | A1 | 2/2012 | Newman, Jr. |
| 2012/0230073 | A1 | 9/2012 | Newman, Jr. et al. |
| 2013/0162167 | A1 | 6/2013 | Gallo |
| 2013/0162168 | A1 | 6/2013 | Ostrovsky |

FOREIGN PATENT DOCUMENTS

| | | | |
|---|---|---|---|
| EP | 2214287 | A2 | 10/2010 |
| JP | 20083022771 | A1 | 12/2008 |
| WO | 9010942 | A1 | 9/1990 |
| WO | 0182321 | A1 | 1/2001 |
| WO | 2006091565 | A2 | 8/2006 |
| WO | 2008102147 | A1 | 8/2008 |
| WO | 2009127340 | A3 | 12/2009 |
| WO | 2011101282 | A1 | 8/2011 |
| WO | 2011101680 | A2 | 8/2011 |

OTHER PUBLICATIONS

Leviton, Product Data, Z-MAX Relay Cards, 2009, 2 pages.
Lighting Controls, Lighting Control & Design-Product Catalog, Oct. 2008, 101 pages.
SVEA Building Control Systems—LON I/O Module REG-M DIM 1-10V, May 16, 2007, 4 pages.
Wattsupmeters, Smart Circuit, "Electricity Controller—Applications," Mar. 30, 2010, 2 pages.
Wattsupmeters, Smart Circuit, "Methodology for Commercial Applications," Mar. 30, 2010, 2 pages.
Wattsupmeters, Smart Circuit, "The Intelligent Electricity Monitor That Can Measure and Switch Loads Via the Internet," Mar. 30, 2010.
Wattsupmeters, Smart Circuit, "20 AMP Internet Enabled Electricity Controller," Product Information, 2005 2 pages.
Written Opinion and International Search Report for PCT/US2010/044022, dated Feb. 24, 2011, 10 pages.
U.S. Appl. No. 12/751,956, filed Mar. 31, 2010, 87 pages.
ADMMicro EMSA, "Controllers," 2006, 1 page.
ADMMicro, "What We Do," Controllers, 2006, 3 pages.
Architectural Lighting Magazine, "Load Shedding and Lighting: The New Frontier", printed Mar. 20, 2009, 2 pages.
E-Mon, Energy Monitoring Products E-Mon D-Mon Metering Products, printed Jul. 7, 2009, 1 page.
I.M.S. Industrial Measurement Systems Ltd., "General Information," 2006, 2 pages.
Leviton, "Architectural Lighting Controls," 2007, 21 pages.
Lutron, "Quantium—Whole-Building Light Management Solution," Apr. 30, 2009, 28 pages.
Quad Logic: Power Line Communications Technology, "where There is Power . . . Quadlogic Brings You Knowledge." 2008, 2 pages.
Shadowmetering, "About Shadow Metering Inc., Jacksonville, Florida" 2009, 1 page.
Site Controls: Products and Services, "The Site-Command Platform, 2009," 1 page.
Wattsupmeters, "Smart Circuit—The Intelligent Electricity Monitor that Can Measure and Switch Loads via the Internet, Sep. 2005," 6 pages.
Society of Automotive Engineers, Inc., Surface Vehicle Recommended Practice, 2001, 32 pages.
GM Electric Power/Advanced Systems, "Plug-In Electric Vehicles—Standards," Ontairo Smart Grid Forum, Oct. 14, 2008, 17 pages.
RS485 Serial Information, http://www.lammertbies.nl/comm/info/RS-485.html, 3 pages.
International Preliminary Report on Patentability for PCT/US2010/044022, dated May 15, 2012, 6 pages.
Elliott et al., Office Action for U.S. Appl. No. 2/751,993, filed Mar. 31, 2010, (U.S. Pat. No. 8,324,761) dated May 10, 2012.
Elliott et al., Notice of Allowance for U.S. Appl. No. 12/751,993, filed Mar. 31, 2010, (U.S. Pat. No. 8,324,761) dated Aug. 8, 2012.
Littelfuse, Inc., "AN1002—Teccor Brand Thyristors, gating, Latch-
Littelfuse, Inc., AN1002—Teccor Brand Thyristors, Gating, Latching, and Holding of SCRs and Triacs," 2008, 5 pages.
Littelfuse, Inc., "AN1003—Teccor Brand Tyristors, Phase Control Using Thyristors," 2008, 9 pages.
AN2841 Application Note LED Dimming Implemented or STM32TM Microcontroller, STM Microelectronics, 2008, 31 pages.
Gulati, Anshul "Modulating Techniques for LED Dimming" Cypress Perform, Cot. 22, 2008, 10 pages.
Rosen, Rich, "Dimming Techniques for Switched-Mode LED Drivers," Power Designer, National Semiconductor, 7 pages, 2009.
Leviton—Universal Dimmer (Single Pole or 3 Way), Ct. No. HCM06-ID (lighted), Dec. 29, 2009, 2 pages.
U.S. Appl. No. 12/539,453, filed Aug. 11, 2009, 17 pages.
International Search Report and Written Opinion for PCT/US2010/052145, dated Jun. 28, 2011, 11 pages.
International Preliminary Report on Patentability for Application PCT/US2010/052145, dated Jul. 4, 2012, 8 pages.

* cited by examiner

POWER EFFICIENT LINE SYNCHRONIZED DIMMER

BACKGROUND

In an electrical load dimmer, a technique known as zero crossing detection is conventionally employed, wherein the dimmer is synchronized with one or more phases of an input line voltage to enable the dimmer to properly fire a load controlling switch, such as a TRIAC, at specific firing times with respect to the input line phase. More specifically, a zero crossing is detected by detecting a change in voltage polarity of the input line voltage. In other words, zero crossing is detected when the input line voltage changes polarity at the zero volt level, which triggers a signal in the microprocessor that the voltage level has crossed zero volts.

An electrical load dimmer works by "chopping up" an input line voltage so that the line voltage is delivered to an electrical load only during portions of an input line voltage signal. The line voltage that is delivered to the load by control of the electrical dimmer can be regarded as phase controlled input line voltage. In the case of a light source electrical load, an electrical load can include a light source as well as a driver circuit. A driver circuit among other elements can include a rectifier for rectifying portions of the phase controlled line voltage delivered from the dimmer circuit.

In prior, art designs, zero-crossings of an input line voltage are detected by detecting a change in the polarity of the voltage across an input line voltage terminal and an output load terminal (that is, in two wire devices without a neutral connection), or across the input line voltage terminal and return neutral or ground wire terminal (in three wire devices with a neutral connection or two wire devices using a ground leakage path).

BRIEF DESCRIPTION

There is set forth herein a dimmer circuit for controlling delivery of input line voltage to a load. The dimmer circuit can include a switch coupling an input line voltage terminal to a load terminal. The dimmer circuit can be operative to provide one or more switch firing control scheme for latching the switch.

Additional features and advantages are realized through the concepts of the present invention. Other embodiments and aspects of the invention are described in detail herein and are considered a part of the claimed invention.

BRIEF DESCRIPTION OF THE DRAWINGS

One or more aspects of the present invention are particularly pointed out and distinctly claimed as examples in the claims at the conclusion of the specification. The foregoing and other objects, features, and advantages of the invention are apparent from the following detailed description taken in conjunction with the accompanying drawings in which:

DETAILED DESCRIPTION

Figure 1:
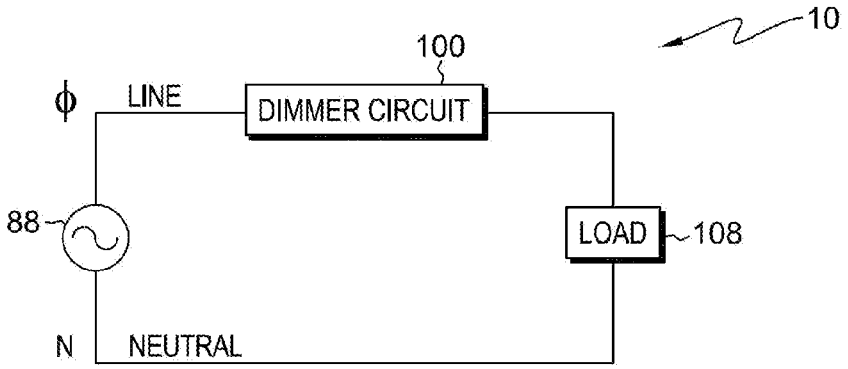
FIG. 1 is a schematic diagram depicting one example of an electrical circuit having a dimmer circuit and a load.
Figure 2:
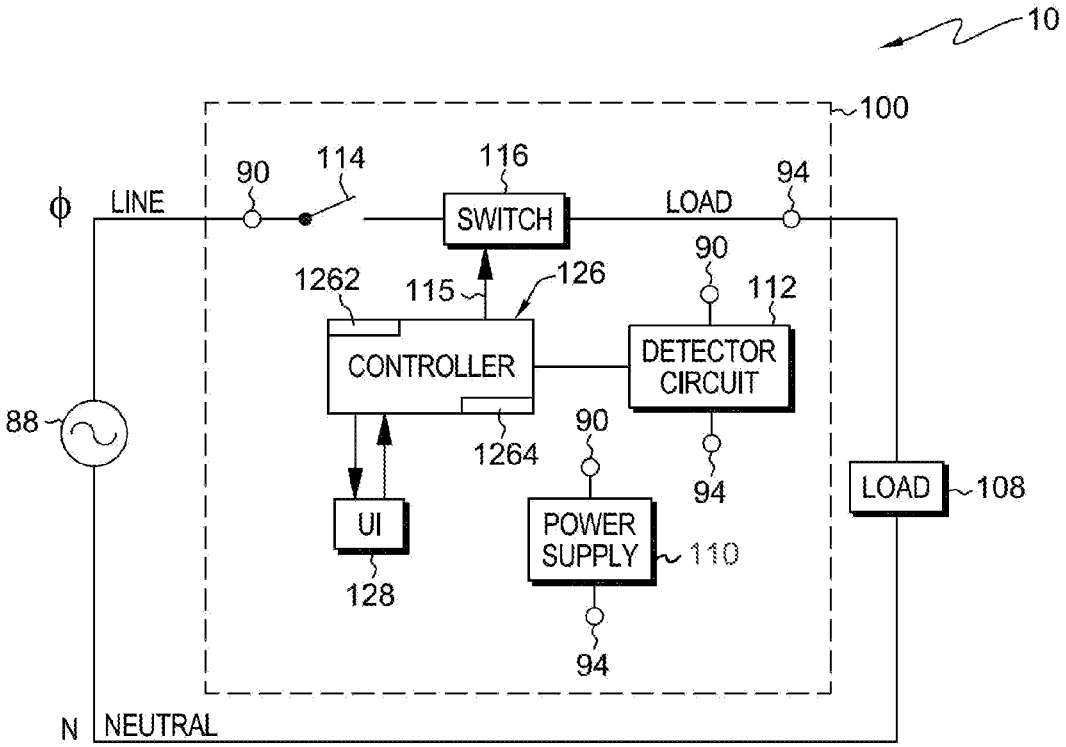
FIG. 2 is a schematic diagram illustrating one example of a dimmer circuit.

There is set forth herein as shown in FIGS. 1 and 2 a dimmer circuit 100 for controlling delivery of input line voltage to a load 108. The dimmer circuit 100 can include an input line voltage terminal 90 configured for connection to a phase (hot) side Θ of an AC power source 88, and a load terminal 94 configured for connection to a load 108. The dimmer circuit 100 can include a switch 116 that couples an input line voltage terminal 90 to a load terminal 94.

There is set forth herein as shown in FIG. 2 an electrical circuit 10 having a dimmer circuit 100 for controlling delivery of input line voltage of an AC power source 88 to a load 108. The dimmer circuit 100 as set forth herein in FIG. 2 can include a switch 116, a detector circuit 112 for detecting voltages including input line voltage and a controller 126 for processing input data and for outputting control signals based on the processing. Controller 126 can control firing (latching) of switch 116 that switches a state of switch 116 from an OFF (unlatched) state to an ON (latched) state. The detector circuit 112 when operating to detect input line voltage can detect input line voltage at one or more phase angles of the input line voltage. The dimmer circuit 100 can deliver phase controlled input line voltage to a load 108 in response to the detection of a specified input line voltage. For driving a load 108, a voltage appearing between phase side Θ and neutral side N of AC power source 88, phase controlled by dimmer circuit 100, can be applied to load 108, resulting in bidirectional current flow through load 108 between phase side Θ and neutral side N of AC power source 88.

The dimmer circuit 100 can be operative to provide one or more switch firing control scheme for latching the switch 116. According to a zero crossing detection firing control scheme, dimmer circuit 100 can control a firing a switch 116 based on a detected zero crossing of an input line voltage and based on a selected brightness level selected by an operator. According to an unlatch monitoring switch firing control scheme, dimmer circuit 100 can monitor switch 116 for unlatching of switch 116 when switch 116 is in an OFF (unlatched) state and can control a firing of switch based on a detected unlatching of switch 116. According to a fourth quadrant firing control scheme, dimmer circuit 100 can control switch 116 to unlatch during a fourth quadrant of a half cycle of an input line voltage. According to a negative half cycle zero crossing detection firing control scheme, dimmer circuit 100 can detect an input line voltage during a negative half cycle of an input line voltage and can fire switch 116 based on a detected input line voltage detected during the negative half cycle. An input line voltage of an AC power source 88 appearing between phase side Θ and neutral side N of AC power source 88, phase controlled by dimmer circuit 100, can be applied to load 108.

In one embodiment, a direct connection by dimmer circuit 100 to neutral side N of AC power source 88 can be available and dimmer circuit 100 can be configured as a three wire dimmer circuit. In one embodiment, as is depicted in FIG. 2, dimmer circuit 100 can be configured as a two wire dimmer circuit. In many household and industrial wiring systems, a connection to a neutral side N of an AC power source 88 other than by load 108 is not available. Where dimmer circuit 100 is a two wire dimmer circuit 100, dimmer circuit 100 can detect input line voltage by detecting voltage across input line voltage terminal 90 and load terminal 94. A detector circuit 112 of dimmer circuit 100, where provided by a two wire dimmer circuit, can include as inputs a voltage of input line voltage terminal 90 which can be connected to a phase side Θ of AC power source 88 and a voltage of load terminal 94, which can be connected to load 108. By the presence of switch 116 which transitions between conducting (latched) and non conducting (unlatched) states, the voltage across input line voltage terminal 90 and load terminal 94 can serve as a measurement of the input line voltage, the oscillating voltage between phase side Θ and neutral side N of AC power source 88. In a switch OFF (unlatched) state a voltage differential between $V_{LINE}$ (the voltage at input line voltage terminal 90) and $V_{LOAD}$ (the load voltage) can be essentially equal to a voltage differential between $V_{\Theta}$ (the voltage at phase side Θ and $V_N$ (the voltage at neutral side N). Accordingly, in properly timed non conducting states of switch 116 that control non conducting phases of dimmer circuit 100 a detection of a voltage across terminals 90 and 94 can serve as a detection of the input line voltage, the voltage across phase side Θ and neutral side N of AC power source 88, it has been observed, however, that a measurement of a voltage across terminals 90 and 94 does not always accurately indicate an input line voltage. In one example, load 108 can be an active load that can store charge. In such an example, a voltage differential can be present between neutral side N of AC power source 88 and load terminal 94 when switch 116 is in an unlatched state FIG. 2 depicts one example of a dimmer circuit 100 incorporated in an electrical circuit 10 comprising a detector circuit 112, the dimmer circuit 100 facilitating controlling electrical power to a load 108. In FIG. 2, dimmer circuit 100 (also referred to herein as a "dimmer" or "dimmer switch") is able to activate, and control power to, a load 108 which can be connected to neutral side N of AC power source 88. When switch 116 is latched, an input line voltage, phase controlled by dimmer circuit 100, can be provided to load 108, with a return path for current to flow being provided by neutral side N of AC power source 88.

Dimmer circuit 100 can include a controller 126 coupled to user accessible user interface 128. Controller 126 can be provided by a microprocessor, which can be incorporated on a microprocessor integrated circuit chip. Controller 126 can include one or more of a complex instruction set computer processor and a reduced instruction set computer processor. Controller 126 can include a memory 1262 and a timer 1264. An operator of dimmer circuit 100 is able to engage one or more actuators of user interface 128, which controller 126 may interpret as a command (or a set of commands) to perform one or more actions for controlling load 108. In response to the received command information, dimmer circuit 100 can control the delivery of electrical power of AC power source 88 to load 108. In one embodiment, dimmer circuit 100 can be configured so that memory 1262 stores a record of events of dimmer circuit 100 including firings of switch 116 and detected voltages detected by dimmer circuit 100. Using an output of timer 1264 a record of events recorded in memory 1262 can be a timestamped record of events, each recorded event having an associated recorded timestamp. Because nominal characteristics of AC power source 88 are known, an output of timer 1264 can indicate a current phase angle of an input line voltage.

In one embodiment, load 108 can include a light source 1082 in combination with driver circuit 1081. A driver circuit 1081 of load 108 can include a rectifier 1083 and a holding capacitor 1084. Where load 108 is of a type depicted in FIG. 3, load 108 can be regarded as an active load. A driver circuit 1081 can also include control circuit 1085. In one embodiment, control circuit 1085 can include pulse width modulation (PWM) circuitry for providing a pulse width modulated voltage across light source 1082. Light source 1082 can include, e.g., one or more light emitting diode (LED) light source or a compact fluorescent lamp (CFL). Where load 108 includes a light source provided by an incandescent light bulb, load 108 can be a passive load and can be absent of driver circuit 1081. Where load 108 includes an incandescent light bulb, load 108 can operate essentially as a purely resistive load.

Figure 4:
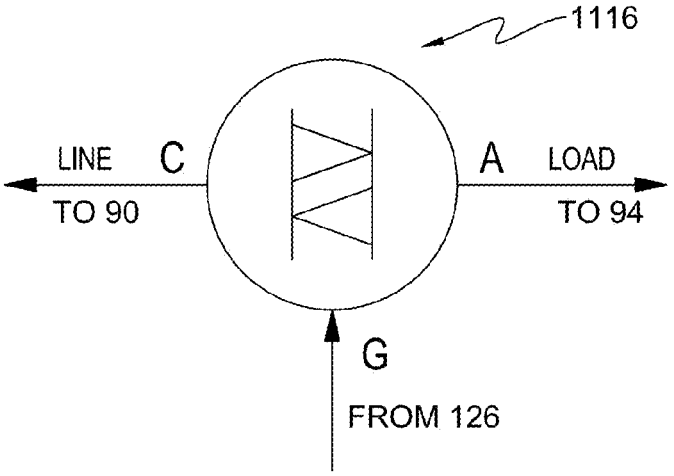
FIG. 4 is a schematic diagram of a triode for alternating current (TRIAC)

In one embodiment, dimmer circuit 100 can control, for example, the amount of current flowing through load 108 by proper activation of a switch 116. In one embodiment, switch 116 can be provided by a Triode for Alternating Current (TRIAC). Switch 116 when provided by a TRIAC is a bidirectional three terminal semiconductor device that allows bidirectional current flow when an electrical signal of proper amplitude is applied to its "G" (or gate) terminal. Switch 116 when provided by a TRIAC also has a "C" (or cathode terminal) and an "A" or anode terminal. FIG. 4 illustrates an example of switch 116 provided by a TRIAC 1116. When an electrical signal known as a gating signal is applied to the gate G, TRIAC 1116 is said to be gated. Subsequent to being gated, and prior to current flow falling below a holding current, current can flow from the "C" terminal to the "A" terminal or from the "A" terminal to the "C" terminal. Prior to switch 116 (where provided by a TRIAC) being gated, very little or substantially no current can flow between the "A" and "C" terminals. Switch 116 when provided by a TRIAC 1116 can allow current flow when an electrical signal of proper amplitude (a gating signal) is applied to its "G" terminal. Alternatively, switch 116 can be implemented as two TRIACs (not shown), where a first TRIAC is controlled by controller 126 through application of a firing signal onto control line 115 to turn on a second TRIAC TR2, which in turn gates the first TRIACs allowing an AC signal to pass through load 108 and back to AC power source 88 via neutral side N. Accordingly, switch 116 can control delivery of electrical power of AC power source 88 to load 108.

Electrical energy can be provided to load 108 by AC power source 88 having phase (hot) side and neutral side N. The electrical energy can be controlled by switch 116 to switch on load 108, increase or decrease the intensity of load 108, or switch off electrical load 108. Dimmer circuit 100 can also include a mechanical switch such as an air gap switch 114. When air gap switch 114 is open, no current flows through load 108. Opening up mechanical air gap switch 114 is referred to as a "hard switch off" which allows an operator to, for instance, change or replace a light source in load 108 without risk of an electrical shock.

In one embodiment, dimmer circuit 100 can include a controller 126 which can be coupled to detector circuit 112 and user interface 128. Controller 126, which can be provided by a microprocessor, can control the operation of switch 116. A microprocessor of dimmer circuit 100 can be provided by an off-the-shelf processor semiconductor integrated circuit (i.e., a microprocessor integrated circuit chip). Controller 126 in one embodiment can be provided by a digital control circuit, an analog control circuit, or combined digital and analog control circuit designed to perform certain actions depending on the status of various of its inputs. Controller 126 in one embodiment can be provided by a combination of a microprocessor and a control circuit. The electrical energy flowing through load 108 can be a 120/220 volt AC (alternating current), 60/50 Hz signal, etc. The AC signal (current and/or voltage) can be a sinusoidal voltage signal symmetrically alternating about a zero volt reference point, described herein. Detector circuit 112 can detect a voltage across input line voltage terminal 90 and load terminal 94. In one embodiment, as is set forth herein, detector circuit 112 can include a zero crossing detector. A zero crossing detector of detector circuit 112 can detect the zero crossings (polarity transitions) of an input line voltage which occur every half cycle. Controller 126 can use the output of a zero crossing detector of detector circuit 112 for various timing functions such as the proper timing of signals it generates to control switch 116.

Dimmer circuit 100 can include a power supply 110 coupled to input line voltage terminal 90 and load terminal 94. Power supply 110 can employ circuit elements that are used to convert an AC signal to a direct current (DC) (or voltage) that may be used to power electronic circuit components. In one embodiment, power supply 110 can be provided by a 'cat ear' power supply circuit that limits charging voltage for charging, power supply 110 to manageable and safe power conserving levels.

Controller 126 can control switch 116 through control line 115. Controller 126 can control the amount of current flowing through load 108 by applying a certain signal (e.g. a gating signal) to switch 116 through control line 115. For example, controller 126 can cause bursts of the AC signal to go through switch 116 by switching ON and switching OFF switch 116 at a desired rate. The switch ON time period of switch 116 may be equal to, less than, or more than the switch OFF time period. The amount of current flowing through load 108 can depend on the duty cycle (ratio of switch ON time period to switch OFF time period) of the signal applied to the gate of switch 116 where provided by a TRIAC and, thus, the intensity of load 108, such as the intensity of light emitted if load 108 comprises a lighting element, also will depend on this signal.

Figure 5:
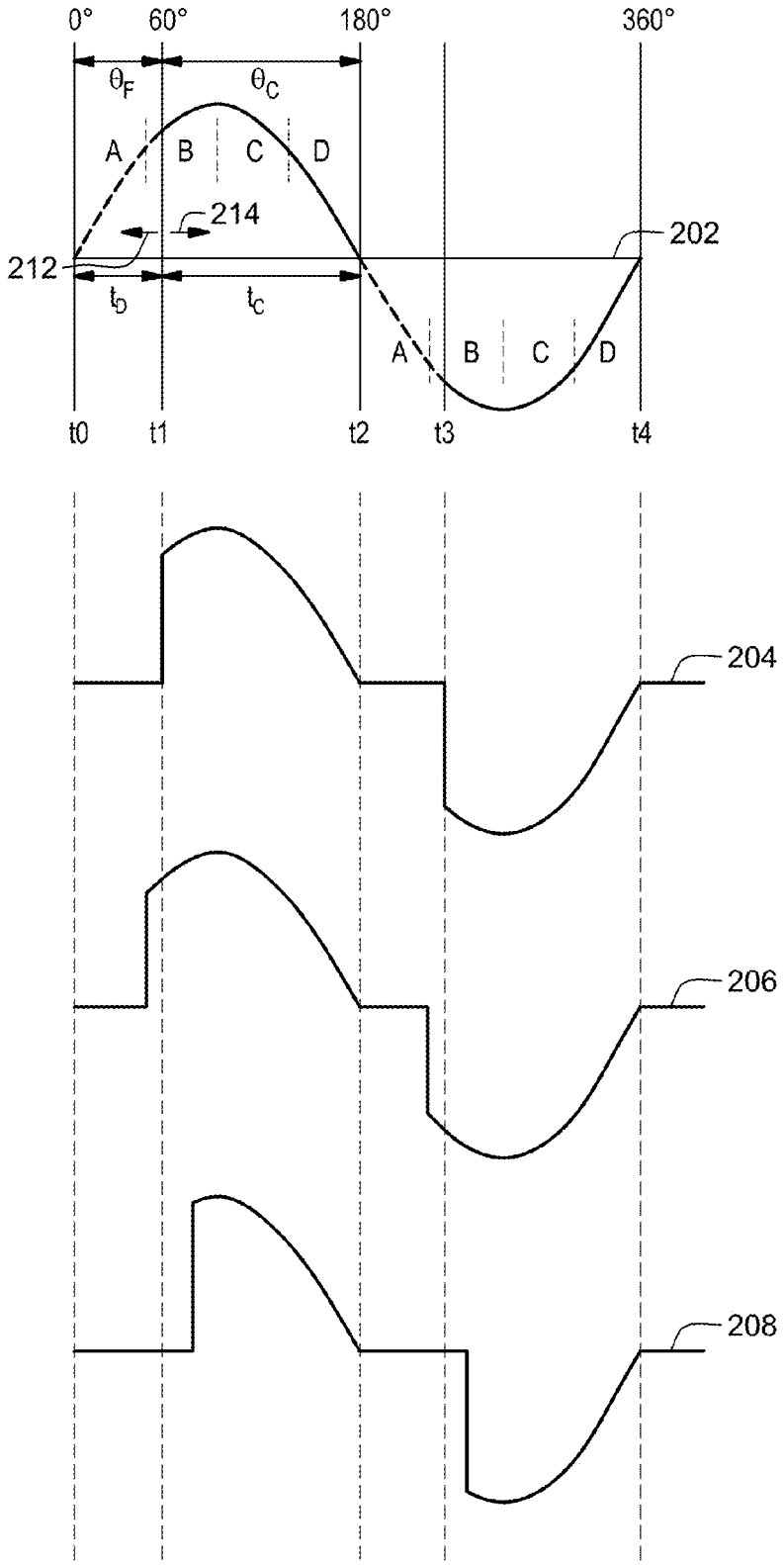
FIG. 5 is a timing diagram illustrating ideal dimmer load control.

The timing diagram of FIG. 5 illustrates ideal operation of dimmer circuit 100 in one embodiment. A phase controlled input line voltage is depicted by timeline 202. Each input line voltage cycle of an AC power source 88 can have a positive half cycle beginning at a first zero crossing time at time $t_0$ and ending at a midpoint (positive to negative) zero crossing time $t_2$. The input line voltage cycle then has a negative half cycle beginning at time $t_2$ and ending at another zero crossing at time $t_4$. For common 60 Hz electrical power the entire line cycle from $t_0$ to $t_4$ lasts 1/60th of a second. A half cycle lasts $1/120^{th}$ of a second.

During a delay period from a zero crossing, $t_D$, switch 116 can remain OFF (unlatched). At time $t_1$ switch 116 can be turned ON (latched) resulting in the input line voltage being delivered to load 108 with a return path of current to neutral side N. Referring to timeline 204, timeline 204 illustrates voltage being delivered to the load 108 under a phase control depicted by timeline 702. Switch 116 can be a self commutation switch so that switch 116 stops conducting when current through switch 116 falls below holding current level. When the current through switch 116 falls below its holding current level, switch 116 can turn OFF again so that voltage will no longer be applied to load 108. As depicted, switch 116 can cut OFF at time $t_2$ (about the zero crossing time) and switch 116 can be turned ON again (latched) at time $t_3$.

Dimmer circuit 100 can include a firing angle $\Theta_F$ and a conducting angle $\Theta_C$. A firing angle $\Theta_F$ of dimmer circuit 100 is the time ($t_D$) expressed in degrees per half cycle that switch 116 is OFF so that power is not delivered to a load 108. A conducting angle $\Theta_C$ of dimmer circuit 100 is the time ($t_C$) expressed in degrees that switch 116 is ON so that power is delivered to load 108. When an operator adjusts a dimming level of dimmer circuit 100 using user interface 128 a firing angle $\Theta_F$ and conducting angle $\Theta_C$ of dimmer circuit 100 changes. A dimmer circuit 100 can have a non conducting phase which can be active for the time $t_D$ prior to an initial firing of switch 116 to latch switch 116 during a half cycle. A dimmer circuit 100 can have a conducting phase which can be active for the time $t_C$ after an initial firing of switch 116 during the half cycle. For slight (high brightness) dimming, dimmer circuit 100 can cut OFF delivery of the input line voltage to load for only small portions of a cycle, portions occurring only short times from a zero crossing. For increased dimming (low brightness), dimmer circuit 100 can cut OFF delivery of the line voltage to a load for longer times from a zero crossing. In one example, should maximum brightness be desired, dimmer circuit 100 can be fired immediately by the controller 126 when the controller 126 receives the indication that a zero crossing has occurred, so that the switch 116 can be latched for the longest possible period of time before the power phase again transitions to a next half cycle. In contrast, a longer delay in firing the switch 116 after a zero crossing will maintain the switch 116 in an ON state for a lesser duration of time during the half cycle before the next transition, and will result in less current draw and, in the case of a light source, a dimmer light. A control of dimmer circuit 100 to increase brightness as depicted by timeline 206 reduces a firing angle $\Theta_F$ and increases a conducting angle $\Theta_C$ as depicted by arrow 212. A control of dimmer circuit 100 to decrease brightness as depicted by timeline 208 increases a firing angle $\Theta_F$ as depicted by arrow 214 of dimmer circuit 100 and decreases a conducting angle $\Theta_C$ also as depicted by arrow 214. Timeline 204 indicates a load voltage provided by a dimmer circuit 100 operating in accordance with the phase control as depicted in timeline 202. Timeline 206 indicates a load voltage provided by dimmer circuit 100 operating to provide increased light source brightness relative to that indicated by the load voltage depicted by timeline 204. Timeline 208 indicates a load voltage provided by dimmer circuit 100 operating to provide decreased light source brightness relative to a brightness that is indicated by the load voltage depicted by timeline 204.

According to methods and apparatus as set forth herein, dimmer circuit 100 can be operative to provide one or more switch firing control scheme so that operation of dimmer circuit 100 can be in accordance with the ideal operation as depicted in FIG. 5 for an increased range of light source loads. Light source loads that can be controlled with use of dimmer circuit 100 can include passive incandescent light source loads, and active light source loads such as LED and CFL loads. Active light source loads such as LED and CFL loads can include high capacitance and low capacitance loads. Where a light source load is an active light source load the light source load can include a driver circuit 1081 as set forth in reference to FIG. 3.

According to one switch firing control scheme that can be provided by dimmer circuit 100, which can be regarded as a zero crossing detection firing control scheme, dimmer circuit 100 can detect zero crossings of an input line voltage using one of a 0V zero crossing detection method or a nonzero threshold voltage detection method that detects for a voltage having a nonzero absolute value of greater than 0 volts as set forth herein.

According to another switch firing control scheme that can be provided by dimmer circuit 100, which firing control scheme can be regarded as a switch unlatch monitoring firing control scheme, dimmer circuit 100 can monitor for changes in a switch voltage, $V_{SWITCH}$ (the voltage across input line voltage terminal 90 and load terminal 94) when switch 116 is in a latched state, the switch voltage indicative of the switch latched/unlatched state. Based on a detection of a switch 116 unlatching, dimmer circuit 100 can fire the switch 116, so that an unlatching period is minimized (e.g. by applying in response to the detection without delay a gating signal in the case switch 116 is provided by a TRIAC).

According to another switch firing control scheme that can be provided by dimmer circuit 100, which can be regarded as a fourth quadrant firing control scheme, dimmer circuit 100 can control switch 116 to unlatch during a fourth quadrant of a half cycle of an input line voltage.

According to another switch firing control scheme that can be provided by dimmer circuit 100, which can be regarded as a negative half cycle zero crossing detection firing control scheme, dimmer circuit 100 can detect a first input line voltage during a positive half cycle and can detect a second input line voltage during a negative half cycle of an input line voltage and can use the detected first and second voltages for firing the switch 116 during the positive and negative half cycles, respectively, of an input line voltage of the AC power source 88.

Aspects of dimmer circuit 100 providing a zero crossing firing control scheme are set forth in connection with FIGS. 6-8.

Figure 6:
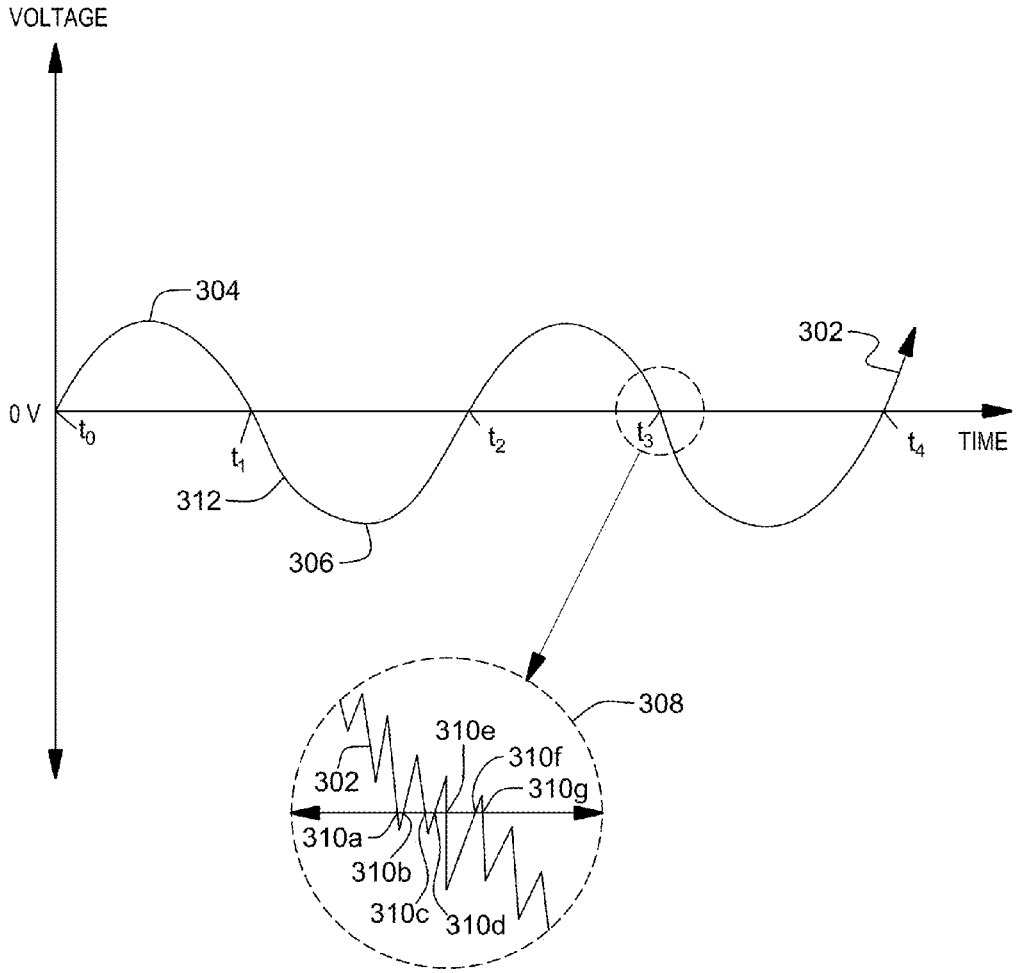
FIG. 6 depicts one example of a voltage signal diagram for an electrical power phase.

FIG. 6 depicts one example of a voltage signal diagram for an electrical power phase. An AC input line voltage 302 has an amplitude that oscillates between positive and negative voltage levels at a substantially regular frequency. Operating voltages generally, though not always, are set at between 120V and +/−240V, and have frequencies between 50 and 60 Hz. The input line voltage 302 follows generally a sinusoidal pattern, having a repeating full phase (e.g., from time $t_0$ to time $t_2$, time $t_2$ to time $t_4$, etc.) and having repeating half cycles (e.g., positive half cycle 304, negative half cycle 306) of each full phase. The point(s) at which the input line voltage 302 changes voltage polarity (e.g., from positive voltage to negative voltage, or negative voltage to positive voltage) is referred to as a zero crossing and occurs when input line voltage 302 crosses the 0 voltage (0V) level. In FIG. 6, zero crossings occur at times $t_0$, $t_1$, $t_2$, $t_3$, and $t_4$ Dimmer circuit 100 can "chop up" the input line voltage so that the input line voltage can be a phase controlled input line voltage delivered to load 108 for only a portion of each half cycle. In one aspect dimmer circuit 100 cart control a load based on detection of a zero crossing.

In the development of methods and apparatus herein, it was determined that a zero crossing approach for dimming where dimming is based on an input AC power source voltage exceeding zero volts can yield error for certain types of loads. In practice, fluctuations in load current can result in a noisy electrical power phase. This occurs in many different types of electrical devices, with some electrical devices (such as loads including LED and CFL light sources with capacitive driver circuits) experiencing more frequent reversals in load current about a zero crossing than are experienced in other types of electrical devices, such as incandescent lamps. In general, the closer the voltage level of the phase is to 0V, the more noise that is experienced. As a result of this noise, multiple changes of polarity occur and are sensed when input line voltage 302 as depicted in FIG. 6 transitions from one half cycle to another half cycle—for instance from a positive half cycle to a negative half cycle, or vice versa. The magnified view 308 in FIG. 6 illustrates an increase in noise about a zero crossing. As input line voltage 302 approaches the 0V level from the positive voltage level direction, and proceeds beyond the 0V level, several zero crossings (310*a*, 310*b*, . . . , 310*g*) occur. Eventually, input line voltage 302 completes the transition from positive half cycle to negative half cycle (in this example). This happens when input line voltage 302 has progressed sufficiently beyond the 0V level such that spikes in the input line voltage 302 do not reach above the 0V level. In FIG. 6, the last voltage polarity reversal occurs at 310*g*, and the transition has fully taken place only after occurrence of this last reversal.

Thus, it can be seen that noise results in several detections of zero crossings when change in voltage polarity (0 V) is sensed for detecting zero crossings. The multiple transitions lead to undesirable 'false triggering' whereby one or more zero crossings occur and are detected despite the input line voltage 302 having not yet fully completed the transition from one half phase to another half phase. Resulting from this false triggering are potentially premature and undesired control actions by circuitry of the dimmer circuit 100 to control operation thereof. For instance, multiple zero crossings detections (and signaling thereof) cause a relatively rapid firing of the switch 116, e.g., the TRIAC; 1116 (using the above example), and in some applications, such as LED dimming. False triggers can cause undesirable effects to the load, such as flickering, in the case where the load comprises one or more LED or one or more CFL light source.

In accordance with aspects set forth herein, AC power source input line voltage detection can be provided to improve the synchronization capabilities of the dimmer circuit 100, and to avoid false triggering that occurs in the above described approach, in accordance with aspects as set forth herein, rather than detect when the input line voltage crosses zero volts, dimmer circuit 100 can be operative to detect a zero crossing based on a threshold voltage being reached. Dimmer circuit 100 can be operative to detect that a zero crossing has occurred when dimmer circuit 100 detects when the absolute value of the voltage level of the AC power source 88 (the voltage across phase side Θ and neutral side N, as measured by detecting a voltage across an input line voltage terminal 90 and a load terminal 94) reaches a nonzero voltage threshold, such as a predefined nonzero voltage threshold value. By placing this trigger point above (or below) zero volts, false triggering due to the multiple voltage polarity reversals caused by the fluctuations in load current near zero is avoided. While current changes (from increasing to decreasing and vice versa) can occur away from the zero voltage level, these changes are small enough that they do not cause polarity reversals and can be ignored. The significant fluctuations of the load current near the zero voltage level diminish once the line voltage has had chance to rise above the zero potential. In one embodiment, a nonzero threshold voltage used by detector circuit 112 to detect a zero crossing can be at least 5 V. In one embodiment, a nonzero threshold voltage used by detector circuit 112 to detect a zero crossing can be at least 10 V. In one embodiment, a nonzero threshold voltage used by detector circuit 112 to detect a zero crossing can be at least 20 V. In one embodiment, a nonzero threshold voltage used by detector circuit 112 to detect a zero crossing can be at least 30 V. In one embodiment, a nonzero threshold voltage used by detector circuit 112 to detect a zero crossing can be at least 40 V. In one embodiment, a nonzero threshold voltage used by detector circuit 112 to detect a zero crossing can be at least 50 V. In one embodiment, a nonzero threshold voltage used by detector circuit 112 to detect a zero crossing can be at least 60 V. In one embodiment, a nonzero threshold voltage used by detector circuit 112 to detect a zero crossing can be at least 70 V. In one embodiment, a nonzero threshold voltage used by detector circuit 112 to detect a zero crossing can be at least 80 V. In one embodiment, a nonzero threshold voltage used by detector circuit 112 to detect a zero crossing can be at least 90 V. In one embodiment, a nonzero threshold voltage used by detector circuit 112 to detect a zero crossing can be at least 100 V. The nonzero threshold voltage used for zero crossing detection can be a value appreciably above 0 V without negating the ability of dimmer circuit 100 to deliver a majority of power available from AC source 88 to load 108.

Figure 7:
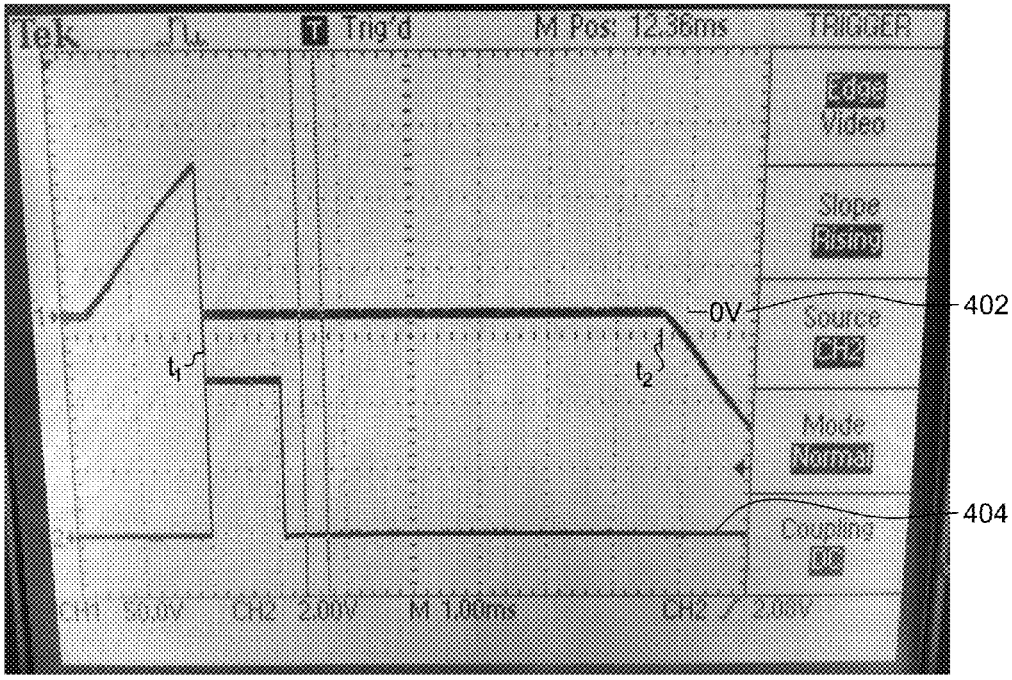
FIG. 7 is an oscilloscope trace for an exemplary passive load.

In FIG. 7 there is illustrated an oscilloscope trace depicting operation of a dimmer circuit 100 operating based on zero crossing detection switch firing control scheme wherein a load is a passive load. Timeline 402 indicates the switch voltage $V_{SWITCH}$, the voltage across line input voltage terminal 90 and load terminal 94 which voltage can be indicative of the input line voltage during a non conducting phase of dimmer circuit 100. Timeline 404 indicates a control signal for controlling switch 116. In the Example of FIG. 7, the load 108 is provided by an incandescent light bulb. An incandescent light bulb can operate essentially as a purely resistive load. In the example provided, a dimmer circuit 100 can be fired at time $t_1$ based on the zero crossing detection prior to time $t_1$. In part because zero crossing can be accurately detected without being susceptible to false reads resulting from noise, the firing of the dimmer circuit 100 based on zero crossing detection results in stable and predictable control of the load. The dimmer circuit 100 is fired at time $t_1$, and from time $t_1$ to time $t_2$, the input line voltage will be applied to load 108. With the current passing from input line voltage terminal 90 to the load terminal 94 falling below a holding current level, the switch 116 enters an OFF state (and unlatches) at the half cycle zero crossing time $t_2$. In the example of FIG. 7, zero crossing is determined using a nonzero threshold voltage zero crossing detection method set forth herein. With a passive (entirely resistive) load, such as a load including an incandescent light source, a same result characterized by predicable control of the load can be expected whether a 0 volt zero crossing detection method or a nonzero threshold voltage based zero crossing method is applied for zero crossing. With certain active loads, (e.g., loads including an LED or CFL light source) predictable control of the load can be expected with use of a nonzero threshold based zero crossing detection method, by which method dimmer circuit 100 is not expected to be susceptible to noise induced false firings as set forth herein.

It has been observed that some electrical loads such as certain types of active light source loads (e.g., certain LED loads and certain CFL loads), are difficult to control even with use of a threshold based zero detection method designed to make dimmer circuit 100 less susceptible to fluctuations in zero crossing.

Figure 3:
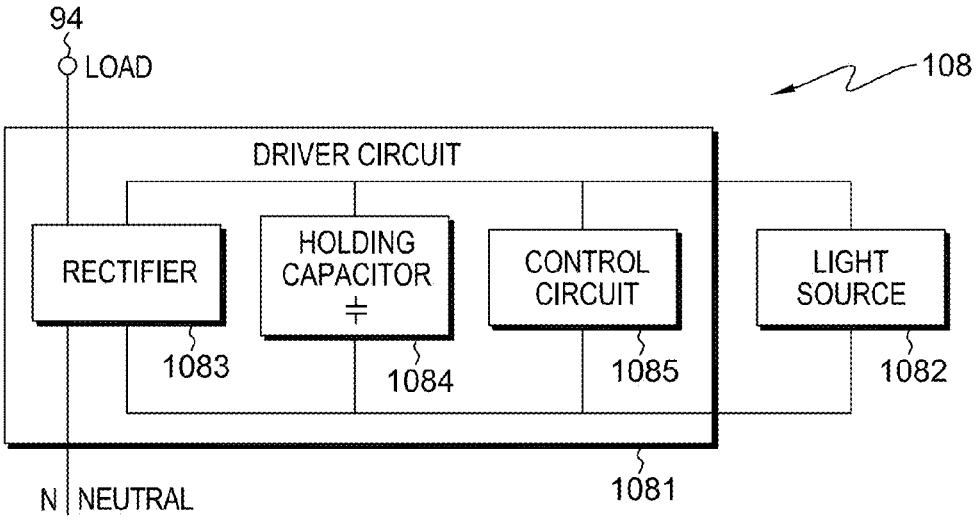
FIG. 3 is a schematic diagram for an active load comprising a rectifier based driver circuit and a light source.
Figure 8:
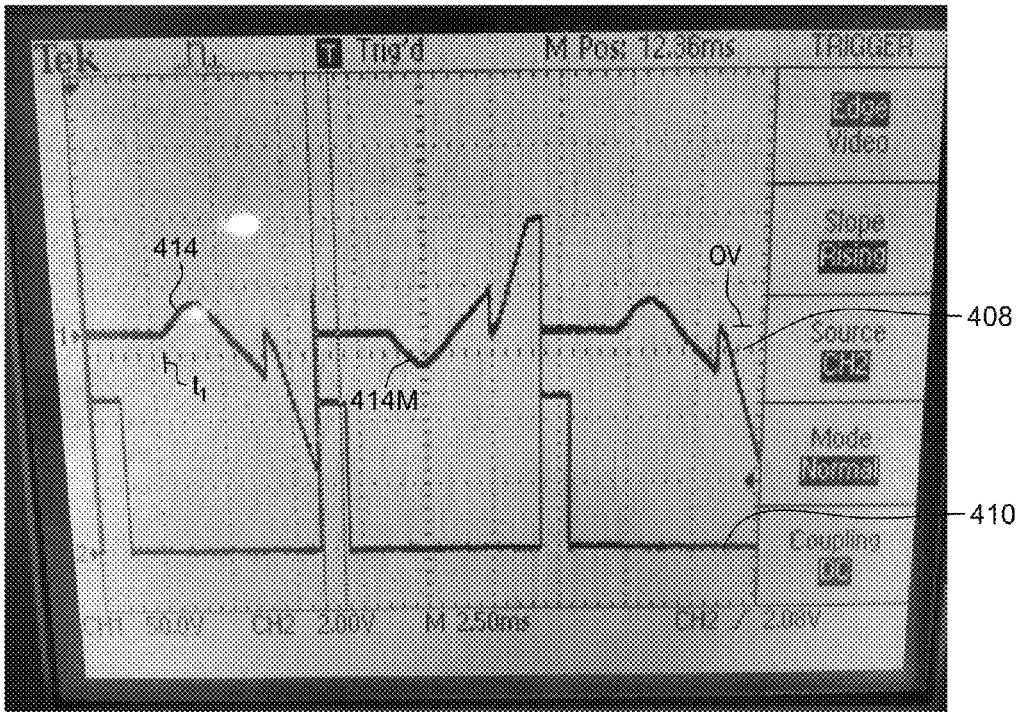
FIG. 8 is an oscilloscope trace for an exemplary active load.

In FIG. 8 there is depicted operation of a dimmer circuit 100 operating in accordance with a nonzero threshold based zero crossing detection method wherein a load is an active load (the load in the example of the oscilloscope trace of FIG. 8 includes a Par 80 LED light source). A light source load, where the light source is an active light source load typically includes a light source in combination with a driver circuit as depicted in FIG. 3. In the example of FIG. 8, load 108 is an active load light source provided by light source 1082 in combination with a driver circuit 1081. In the example provided in FIG. 8, the providing of a nonzero threshold based zero crossing firing control scheme is successful in controlling the switch 116 to fire once per half cycle as indicated by switch control signal timeline 410. However, in spite of the proper firing, the load 108 does not exhibit ideal operation as depicted in the timing diagrams of FIG. 5. While according to an ideal operation set forth in reference to FIG. 5, switch 116 remains conducting after an initial firing of a switch 116 for a remainder of a half cycle, the switch 116 in the example depicted in FIG. 8 does not remain conducting for a remainder of a half cycle after a firing. Referring to the oscilloscope trace of FIG. 8, timeline 408 illustrates a voltage across terminal 90 and load terminal 94 (the switch voltage drop $V_{SWITCH}$ which can also serve as a measurement of the input line voltage when switch 116 is open). At time $t_1$ depicted in timeline 408, switch 116 changes to an OFF state as indicated by the measured switch voltage drop $V_{SWITCH}$ deviating from zero volts. It has been observed that loads with lower capacitances can exhibit the characteristics as shown in the oscilloscope trace of FIG. 8. As indicated in FIG. 3, a light source load 108 can comprise a driver circuit 1081 and a light source 1082. Regarding driver circuit 1081, driver circuit 1081 can include a rectifier 1083 in combination with a holding capacitor 1084. Driver circuit 1081 can also include control circuit 1085 which can include pulse width modulation (PWM) circuitry. It has been observed that with loads having smaller sized holding capacitors, the holding capacitor 1084 can breach and discharge during a half cycle of an input line voltage of power source 88. When holding capacitor 1084 breaches and discharges, a current through load 108 (and through switch 116) can fall to a level below a level necessary to keep switch 116 latched, and consequently switch 116 can unlatch within a current half cycle after it initially latches within the current half cycle.

Referring to FIG. 8 and aspects of a dimmer circuit 100 providing a switch unlatch monitoring firing control scheme are described.

In one aspect of a switch unlatch monitoring firing control scheme for dimmer circuit 100, dimmer circuit 100 can tire switch 116 based on a monitoring of voltage across input line voltage terminal 90 and load terminal 94, the switch voltage, $V_{SWITCH}$. The unlatch monitoring can be performed with the switch 116 in an ON (latched) state after an initial firing of switch 116 during a current half cycle, in one aspect, dimmer circuit 100 can be configured to monitor for voltage changes as are indicated by feature 414 of the oscilloscope trace of FIG. 8 which can occur with dimmer circuit 100 in an conducting phase and with switch 116 in a latched state (just prior to time $t_1$) after an initial firing of switch 116 during a current half cycle. In one aspect there is set forth herein a dimmer circuit 100 having a switch 116 for controlling delivery of power of an AC power source 88 to a load 108, the switch 116 coupling an input line voltage terminal 90 and a load terminal 94, wherein the dimmer circuit 100 is operative, for monitoring a voltage across the input line voltage terminal 90 and the load terminal 94 during a conductive phase of dimmer circuit 100 with switch 116 in a latched state. Dimmer circuit 100 can be operative to detect a change in the state of the switch 116 during a half cycle from an ON state to an OFF state. Based on the monitoring the dimmer circuit 100 can be operative to fire the switch 116 to return the switch to an ON state for a certain remaining portion of a half cycle. Dimmer circuit 100 can be provided so that the firing of the switch 116 can be made without delay after a monitoring determines that an unlatching of switch 116 has occurred.

For the performance of monitoring of voltage across input line voltage terminal 90 and load terminal 94 for determining the latched/unlatched state of switch 116, detector circuit 112 in one embodiment can include appropriate circuitry for digitizing a voltage indicative of the voltage differential across input line voltage terminal 90 and load terminal 94 (the switch voltage, $V_{SWITCH}$) and for inputting the digitized switch voltage, $V_{SWITCH}$, into controller 126. For example, controller 126 can monitor the digitized voltage levels for detection of a voltage change with switch 116 in a latched state, ON detection of switch unlatching, controller 126 can transmit a control signal to switch 116 (e.g. a gating signal in the case switch 116 is provided by a TRIAC) to re-fire switch 116 so that the unlatched time within the current half cycle is minimized. Dimmer circuit 100 can be operative to re-fire switch 116 without delay responsively to an unlatching of switch 116 being detected. Detector circuit 112 can detect for changes in a voltage across input line voltage terminal 90 and load terminal 94 using alternative circuitry, as will be set forth herein.

Figure 9:
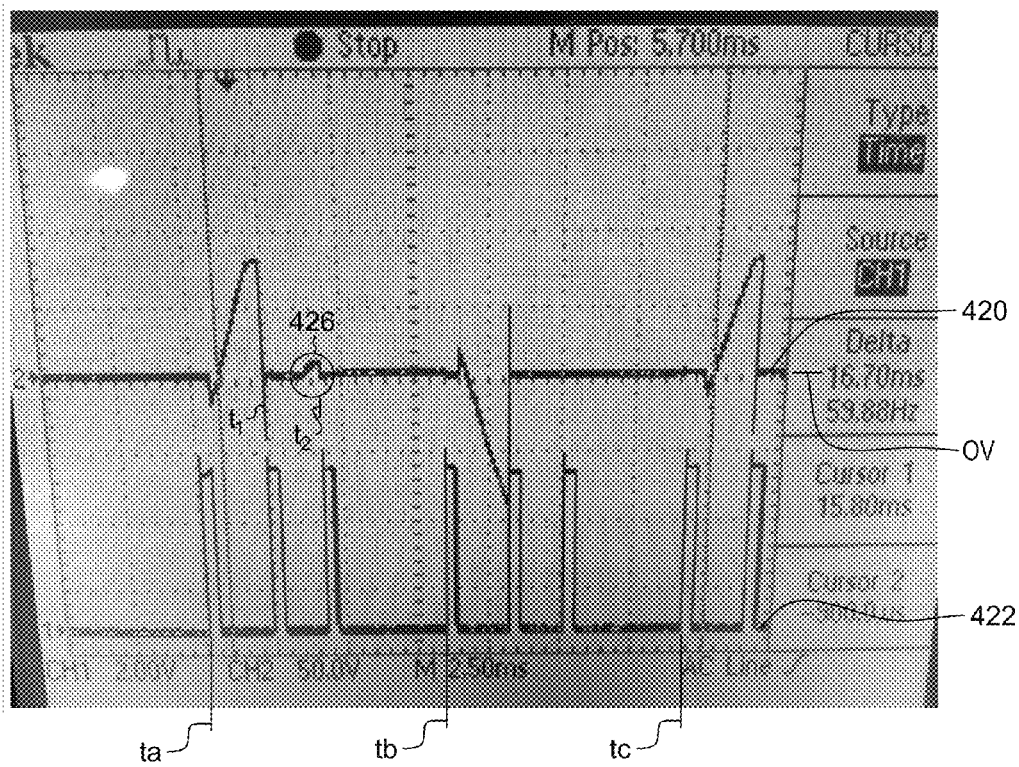
FIG. 9 is an oscilloscope trace for an exemplary active load controlled according to a plurality of switch firing control schemes.

The oscilloscope trace of FIG. 9 illustrates control of a load by dimmer circuit 100 where dimmer circuit 100 is configured to provide a switch unlatching monitoring firing control scheme. Referring to timeline 422, an initial firing of switch 116 during a half cycle is depicted as occurring at time $t_1$. Dimmer circuit 100 can fire switch 116 again at time $t_2$ based on voltage change feature 426 of the signal depicted by timeline 420 being detected by dimmer circuit 100.

It has been observed that monitoring for unlatching of switch 116 can consume a non negligible amount of power and processing time of controller 126. To reduce power and processing budgets, dimmer circuit 100 can be operative so that when switch 116 is fired based on an unlatch monitoring switch firing control scheme, a timing parameter of the unlatch, monitoring can be stored into a memory 1262 of dimmer circuit 100 and can be used for control of a firing of switch during a subsequent half cycle. In one embodiment, controller 126, e.g., where provided by a microprocessor IC chip can have an on board memory 1262 and timer 1264. Memory 1262 can store a record of timestamped events of an input line voltage cycle, e.g., zero crossing detections, switch unlatch detections, switch firings, and by virtue of nominal timing characteristics of a input line voltage being known, e.g., having a nominal cycling frequency of 60 Hz, timer 1264 may provide information of a current phase angle of an input line voltage.

Dimmer circuit 100 during a subsequent half cycle or series of half cycles of AC power source 88 can use the timing parameter which can be stored in memory 1262 as set forth herein for firing of the switch 116. Switch 116 can be fired by dimmer circuit 100 at a time within a current half cycle that corresponds to the time of an unlatch monitoring based firing of a prior half cycle in which a switch unlatch was detected by dimmer circuit 100. In one embodiment, the timing parameter can be the time from an initial firing of switch 116 during a half cycle at which dimmer circuit 100 fires switch 116 based on an unlatch monitoring. In one embodiment, an initial firing of switch during a half cycle is a firing responsive to a zero crossing detection (0V based or nonzero threshold voltage based). Accordingly, dimmer circuit 100 can be configured so that if dimmer circuit 100 during a first half cycle detects a voltage change feature 426 10 degrees from an initial switch firing time of that first half cycle, and fires switch 116 15 degrees from the initial half cycle firing time based on that unlatch detection, dimmer circuit 100 can fire switch 116 15 degrees from an initial switch firing time of a subsequent, e.g., a successive half cycle. In one embodiment, the timing parameter can be the time from an initial firing of switch 116 during a half cycle at which dimmer circuit 100 detects an unlatch event in performing an unlatch monitoring. In one embodiment, dimmer circuit 100 can be configured so that if dimmer circuit 100 during a first half cycle detects a voltage change feature 426 10 degrees from an initial switch firing time of that first half cycle, and fires switch 116 15 degrees from the initial half cycle firing time based on that unlatch detection, dimmer circuit 100 can subsequently fire switch 116 10 degrees or less than 10 degrees (a number of degrees that is based on the earlier detection time rather than the earlier firing time) from an initial switch firing time of a subsequent, e.g., a successive half cycle. In such embodiment, dimmer circuit 100 can be configured so that dimmer circuit 100 re-fires switch 116 at or prior to a time it becomes unlatched, effectively preempting an un-latching of switch 116 (and therefore also preempting a re-firing of switch 116).

It has been observed that a load characteristic undergoing a switch unlatch event can result in a "mirror image" switch unlatch event occurring between subsequent half cycles. Referring to the oscilloscope trace of FIG. 8, a switch voltage $V_{SWITCH}$ having voltage change feature 414 indicative of a switch unlatch event can have a corresponding mirror image voltage change feature 414M indicative of a switch unlatch event during a subsequent, e.g., successive, half cycle. Accordingly, it was determined that firing of switch 116 during a current half cycle (e.g., a negative half cycle) based on a timing parameter of an unlatch monitoring switch firing of a prior half cycle (e.g., the preceding positive half cycle) can result in successful re-latching of switch 116 or maintaining of switch 116 in a latched state without a detection of an unlatching of switch 116 in the current half cycle.

In accordance with the switch unlatch monitoring firing control scheme set forth herein, it will be seen that switch 116 can be fired a variable number of times within a current half cycle of an input line voltage, wherein the number of times that switch 116 is fired during a current half cycle that depends on characteristics of load 108. For example, as depicted in FIG. 7, the unlatch detection monitoring can be expected to result in zero additional switch firings by operation of the unlatch detection monitoring in the case that load 108 is a purely resistive load. In the case that load 108 is an active load, a switch unlatch monitoring can result in an undetermined number (e.g., 0 to N) of switch firings during a current half cycle depending on how many switch unlatch events are detected in the current half cycle subsequent to an initial switch firing. Switch 116 can be fired an undetermined number of times (e.g., 0 to N times) in accordance with the switch unlatching monitoring firing control scheme set forth herein. There is set forth herein a dimmer circuit 100, wherein the dimmer circuit 100 in accordance with a switch unlatch monitoring firing control scheme is operative to fire the switch a variable number of times between the initial firing time and the end of the half cycle of the input line voltage, the variable number of times ranging from zero times to an integer number of times that is greater than zero, the number of times of the variable number times being based on a characteristic of the load.

Figure 13:
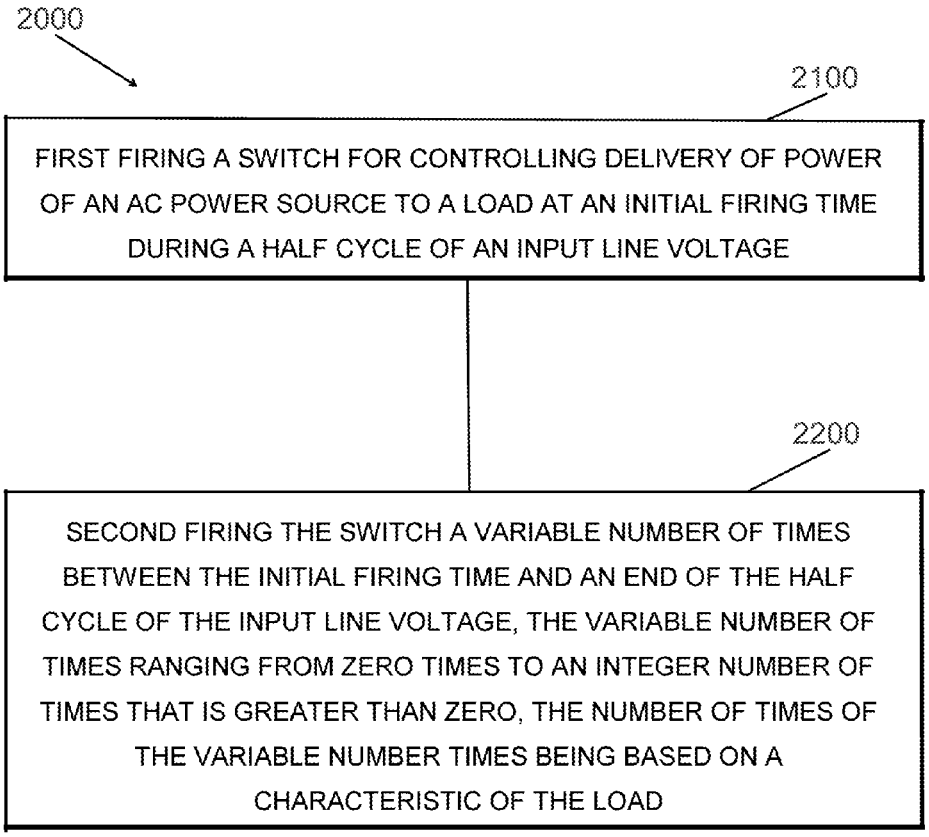
FIG. 13 is a flowchart of a method according to an embodiment of the present disclosure.

As shown in FIG. 13, a method 2000 includes at 2100 first firing a switch for controlling delivery of power of an AC power source to a load at an initial firing time during a half cycle of an input line voltage, and at 2200 second firing the switch a variable number of times between the initial firing time and an end of the half cycle of the input line voltage, the variable number of times ranging from zero times to an integer number of times that is greater than zero, the number of times of the variable number times being based on a characteristic of the load.

It has been described that the switch voltage, $V_{SWITCH}$, can be representative of an input line voltage, the voltage between phase side Θ and neutral side N of AC power source 88 (FIGS. 1 and 2). It has been observed that when using a switch unlatching monitoring firing control scheme as set forth herein, the switch voltage, $V_{SWITCH}$, may not be representative of the input line voltage. For example, at the time an unlatching is detected, the switch voltage, $V_{SWITCH}$ may not have increased to a sufficient level to be representative of an input line voltage.

It has been observed that when a voltage of AC power source 88 is at an amplitude approaching a zero crossing and indicating that a current half cycle is nearly complete, particularly when dimmer circuit 100 is used with active loads, there is a risk of unlatching of switch 116 or other unpredictable control of load 108.

In accordance with another switch firing control scheme that can be provided by dimmer circuit 100 which can be regarded as a forth quadrant firing control scheme, dimmer circuit 100 can be operative so that dimmer circuit 100 fires switch 116 proximate in time but prior to an input line voltage of AC power source 88 reaching a zero crossing. Referring to FIG. 5 each cycle of an input line voltage can be divided into four quadrants A, B, C, and D. The fourth quadrant D of the positive half cycle ranging from 135 degrees to 180 degrees and the fourth quadrant D in a negative half cycle ranging from 315 degrees to 360 degrees. In one embodiment, dimmer circuit 100 is operative to fire switch 116 during a fourth quadrant of a half cycle and in one embodiment during a fourth quadrant of each half cycle of a succession of half cycles. By firing switch 116 at a time proximate the end of a current half cycle but prior to the end of a current half cycle, unlatching of switch 116 and other unpredictable events can be minimized. In one embodiment, switch 116 can be fired at a predetermined phase angle, e.g., 170 degrees (10 degrees from the end of a half cycle), fir each positive half cycle, and 350 degrees (10 degrees from the end of a half cycle) for each negative half cycle. The time at which a fourth quadrant switch firing is initiated can be based on a current detection of a switch voltage $V_{SWITCH}$ (the voltage between terminal 90 and terminal 94). For example, controller 126 can be continuously monitoring digitized voltages indicative of the current switch voltage, $V_{SWITCH}$, and can fire switch 116 when the current switch voltage $V_{SWITCH}$, reaches a voltage level indicative of the input line voltage being at a voltage that is within a fourth quadrant of a current half cycle. The voltage level can be a voltage level indicative of the input line voltage being at a certain predetermined phase angle of a current half cycle (e.g. 10 degrees from the end of the current half cycle in one embodiment).

In another example, a firing time of switch 116 for a half cycle fourth quadrant firing can be based on detected switch voltage, $V_{SWITCH}$, and further based on known characteristics of an input line voltage. For example, the firing time can be determined based on a detected zero crossing of an input line voltage and further based on a known characteristics of a nominally operating AC power source e.g., the known nominal frequency of nominal AC power source 88 to which dimmer circuit 100 can be connected. A known characteristic of AC power source 88 can include the characteristic that a half cycle time of such voltage source will be approximately 1/120 second in the case of a 60 Hz AC power source. In one example, a firing time of a fourth quadrant firing of switch 116 can be determined based on a detected zero crossing (e.g., 0V based or threshold voltage based) indicative of a beginning of a current half cycle and based on the known time delay to a predetermined time before the end of the current half cycle using the known characteristic of power source 88 that a half cycle time of such voltage source will be approximately 1/120 second in the case of a 60 Hz AC power source. A firing time can be determined as a predetermined time (phase angle) before the end of a current half cycle. Referring to the example illustrated with timeline 422 of the oscilloscope trace of FIG. 9, dimmer circuit 100 fires a fourth quadrant firing; pulse at times $t_a$, $t_b$, and $t_c$. In accordance with a fourth quadrant firing control scheme, dimmer circuit 100 can be operative to fire switch 116 in accordance with that particular firing control scheme a predetermined number of times during each half cycle of a succession of half cycles irrespective of any sensed condition. The predetermined number of times can be one time per each half cycle. In one embodiment, dimmer circuit 100 for a succession of half cycles, can be operative to fire switch 116 at a common predetermined phase angle relative to the end of the current half cycle, e.g. at the phase angle of 10 degrees from the end of the half cycle, for a succession of half cycles of the input line voltage.

In one aspect, in order to prevent an unlatching of switch 116 after it is latched initially during a half cycle of an input line voltage, dimmer circuit 100 can be made to fire switch 116 continuously for a remainder of a half cycle after an initial half cycle firing. While such switch control can be advantageous in some embodiments, the noted continuous fire switch control has been observed to be disadvantageous in various aspects. It has been observed that continuous firing of switch 116 can have negative effects. In one aspect, continuous firing of switch 116 can consume significant, power. In another aspect, continuous firing of switch 116 can heat up switch 116 causing thermal stresses that can limit the expected lifetime of switch 116.

Referring to a zero crossing detection set forth herein, dimmer circuit 100 can perform a zero crossing detection and based on the zero crossing detection after a delay can fire switch 116 for an initial firing of a switch during a half cycle. The delay can be based on an input of an operator. If an operator using user interface 128 increases brightness, the delay can be reduced so that the firing is closer to the detected zero crossing. If an operator using user interface 128 decreases brightness, the delay can be increased so that the initial firing is a longer period from the zero crossing. The zero crossing can be, e.g., 0V based or threshold voltage based as set forth herein. In one embodiment, dimmer circuit 100 can detect a zero crossing (e.g., using a 0V based or threshold voltage based method) once per cycle during the positive voltage half cycle of each voltage cycle of power source 88 and can cause an initial firing of switch 116 at an initial firing time during each positive half cycle based on the detected zero crossing and based on the operator's selected brightness level. Dimmer circuit 100 could then cause initial firing of switch 116 during each negative voltage half cycle of power source 88 by interpolation using the initial firing time of each preceding positive half cycle and known characteristics of a nominally operating AC power source. In a nominally operating voltage source such as AC power source 88 half cycles are separated in time by time periods of 1/120 sec. in the case of a nominal 60 Hz AC power source. Accordingly, dimmer circuit 100 in one embodiment can be configured to activate an initial firing of switch 116 during a negative voltage half cycle that is based on the initial firing time of the immediately previous positive half cycle and subsequent in time from the initial firing of switch 116 diving the previous (positive voltage) half cycle by the time period of 1/120 sec. (the nominal known time period of an input line voltage half cycle).

It has been observed that due to the unpredictable operation of certain loads, such as active loads, implementation of a switch firing control wherein an initial firing of switch 116 during a negative half cycle is based on interpolation can produce unwanted results. Particularly with active loads, there is an increased risk of a detected zero crossing being unrepresentative of a zero crossing of an input line voltage source. It has been determined that use of interpolation to establish a timing of a switch firing during a negative half cycle of an input line voltage can result in a switch firing error being repeated between successive half cycles.

Therefore, in accordance with another aspect of a dimmer circuit 100, dimmer circuit 100 can be operative to detect a zero crossing during both negative voltage half cycles and positive voltage half cycles of an input line voltage provided by AC power source 88. The zero crossing detection during each half cycle can be, e.g., 0 V based or nonzero threshold, voltage based as set forth herein. In one embodiment, there is set forth herein a switch 116 for controlling delivery of power of an AC power source 88 to a load 108, the switch 116 coupling an input line voltage terminal 90 and a load terminal 94. The dimmer circuit 100 within a non conducting phase of the dimmer circuit 100 occurring during a positive half cycle of the AC power source 88 can detect a first voltage across the input line voltage terminal 90 and the load terminal 94. The dimmer circuit 100 within a non conducting phase of the dimmer circuit 100 occurring during a negative half cycle of the AC power source 88 can detect a second voltage across the input line voltage terminal 90 and the load terminal 94. During the positive half cycle of the AC power source 88, the dimmer circuit 100 can be operative to fire the switch at a time based on the detecting a first voltage (and based on a selected brightness level selected by an operator), and during the negative half cycle of the AC power source 88 the dimmer circuit 100 can be operative to fire the switch 116 at a time based on the detecting second voltage (and based on a selected brightness level selected by an operator).

Figure 10:
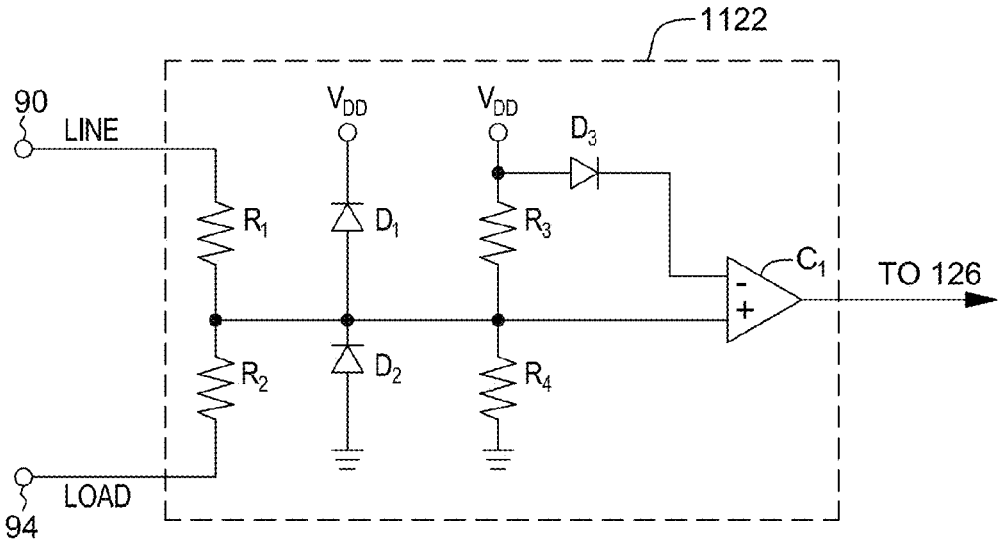
FIG. 10 is a circuit diagram of a zero crossing detector circuit.

In one embodiment, detector circuit 112 can include analog circuit hardware for performing zero crossing detection. An example of a circuit 1122 for detecting a zero crossing of an input line voltage is depicted in FIG. 10. Circuit 1122 as shown in FIG. 10 for use in performing zero crossing detection can be incorporated as part of detector circuit 112. Referring to circuit 1122, circuit 1122 can be connected to input line voltage terminal 90 and to load terminal 94. Circuit 1122 can include resistors $R_1$, $R_2$, $R_3$, $R_4$, diodes $D_1$, $D_2$ and $D_3$, and comparator $C_1$. Resistors $R_1$, $R_2$, $R_3$, and $R_4$ in one embodiment can be sized so that input line voltages spanning a full voltage range (or a truncated range) of AC power source 88, can be conditioned to be voltages input to a positive terminal of comparator $C_1$ in the range of about 0 to 5V.

In another aspect, diodes $D_1$ and $D_2$ can be provided as shown in FIG. 10 to limit comparator positive terminal input voltages to a range of about 5.7 V to about −0.7 V where the reference voltage, $V_{DD}$ at power supply 110, is about 5 V and where a conducting state voltage drop of diodes $D_1$. $D_2$ is about 0.7 V. $D_3$ can be provided to assure that a voltage input to the negative terminal of comparator $C_1$ is less than the reference voltage, $V_{DD}$. In one embodiment, circuit 1122 can be configured so that comparator $C_1$ outputs a logic "1" output when circuit 1122 detects a zero crossing. Circuit 1122 can be configured so that comparator $C_1$ outputs a logic "1" when an input line voltage exceeds 0V or alternatively exceeds a nonzero voltage threshold as set forth herein.

Figure 11:
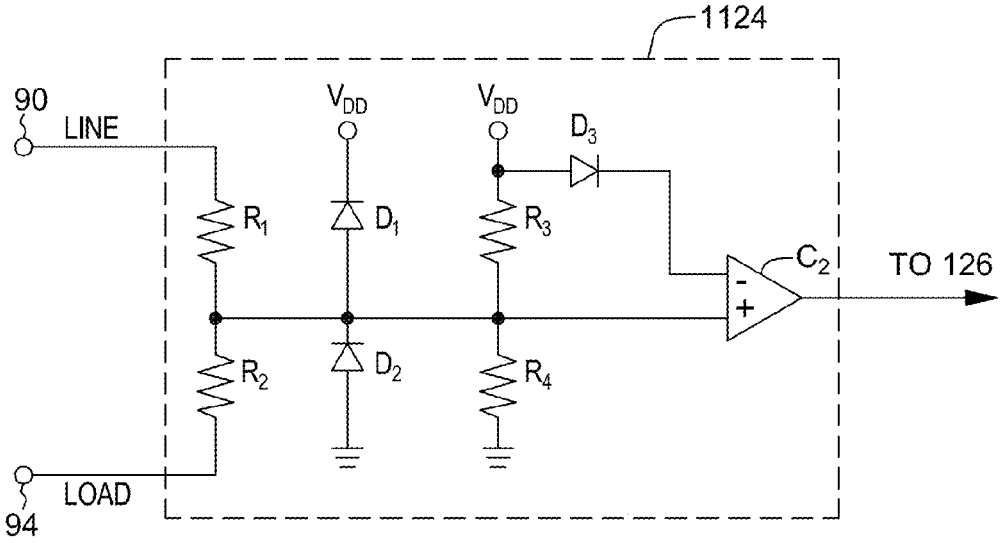
FIG. 11 is a circuit diagram of a switch unlatching detector circuit.

Referring to FIG. 11, a circuit 1124 for performing switch unlatch monitoring, i.e., detecting a change in a switch voltage, $V_{SWITCH}$ after an initial firing of switch 116 during a current half cycle of an input line voltage is shown and described. Circuit 1124 can be used e.g., for detecting a feature such as voltage change feature 426 as depicted in the oscilloscope trace of FIG. 9. Circuit 1124 can have the configuration of circuit 1122 of FIG. 10 except that resistors $R_1$, $R_2$, $R_3$, $R_4$ can be selected so that comparator $C_1$ outputs a logic "1" signal on the switch voltage $V_{SWITCH}$, exceeding a certain voltage value, the certain voltage value being different from a detected switch voltage causing comparator $C_1$ to output a logic "1" output in the case of circuit 1122. In one example, circuit 1122 can be configured to output a logic "1" when a switch voltage, $V_{SWITCH}$, indicative of an input line voltage, exceeds 5V and circuit 1124 can be made to output a logic "1" when a switch voltage, $V_{SWITCH}$, exceeds 10 V. In one example, circuit 1122 can be configured to output a logic "1" when a switch voltage, $V_{SWITCH}$, indicative of an input line voltage, exceeds a threshold of at least 50 V and circuit 1124 can be made to output a logic "1" when a switch voltage, $V_{SWITCH}$, exceeds a threshold that, is no greater than 20 V. In such an embodiment, a voltage threshold used by dimmer circuit 100 for zero crossing detection is greater than a threshold voltage used by dimmer circuit 100 for unlatch monitoring. In one embodiment, circuit 1122 and circuit 1124 can be configured so that each outputs a logic "1" on a detected switch voltage, $V_{SWITCH}$, exceeding a common voltage value.

In one embodiment, circuit 1122 and circuit 1124 can be co-located so that a functionality of circuit 1124 is provided by circuit 1122. In one embodiment, circuit 1122 and circuit 1124 can include on board circuitry of a microprocessor integrated circuit chip which includes controller 126. In one embodiment, circuit 1122 and circuit 1124 can include on board common circuitry of a microprocessor integrated circuit chip which includes controller 126. In one embodiment, a microprocessor integrated circuit which includes controller 126 can be configured so that values of resistors $R_3$, and $R_4$ are programmable in such manner as to be changeable within a time of a current half cycle. Accordingly, circuit elements of a common comparator configured in accordance with circuit 1122 and circuit 1224 can be repurposed and used for determining each of (a) a zero crossing detection (0V based or nonzero threshold based) and (b) one or more unlatch events pursuant to an unlatch monitoring during a current half cycle.

In one embodiment, it can be undesirable for circuit 1124 to trigger latching of switch 116 when circuit 1122 is operating to detect a zero crossing. It can also be undesirable for circuit 1122 to trigger latching of switch 116 when circuit 1124 is operating to detect an unlatching of switch 116. In one embodiment, dimmer circuit 100 can be configured so that circuit 1124 is restricted from triggering latching of switch 116 when circuit 1122 is operating to detect a zero crossing of an input line voltage. In one embodiment, dimmer circuit 100 can be configured so that circuit 1122 is restricted from triggering a latching of switch 116 after an initial firing of switch 116 during a current half cycle.

Dimmer circuit 100, in accordance with features set forth herein, can include a memory 1262 for storing data providing a record of latching events of switch 116 during a current half cycle and can also include a timer 1264, an output of which, based on known characteristics of a nominally operating AC power source 88 indicates a current phase, angle. In one embodiment, dimmer circuit 100 can be configured so that dimmer circuit 100, using data stored in memory 1262 providing a record of prior latching events of switch 116 and using an output timer 1264 that indicates a current phase angle, is restricted from being responsive to a zero crossing (0V based or nonzero threshold voltage based) detection by circuit 1122 for triggering a switch 116 unless switch 116 has not been previously fired during a current half cycle. In one embodiment, dimmer circuit 100 can be configured so that dimmer circuit 100 using data stored in memory 1262 providing a record of prior latching events of switch 116 during a current half cycle and an output timer 1264 that indicates a current phase angle, is restricted from being responsive to monitoring of a switch voltage $V_{SWTCH}$, for triggering switch 116 based on unlatching of switch 116 as detected by circuit 1124 unless switch 116 has been initially fired during a current half cycle.

Figure 12:
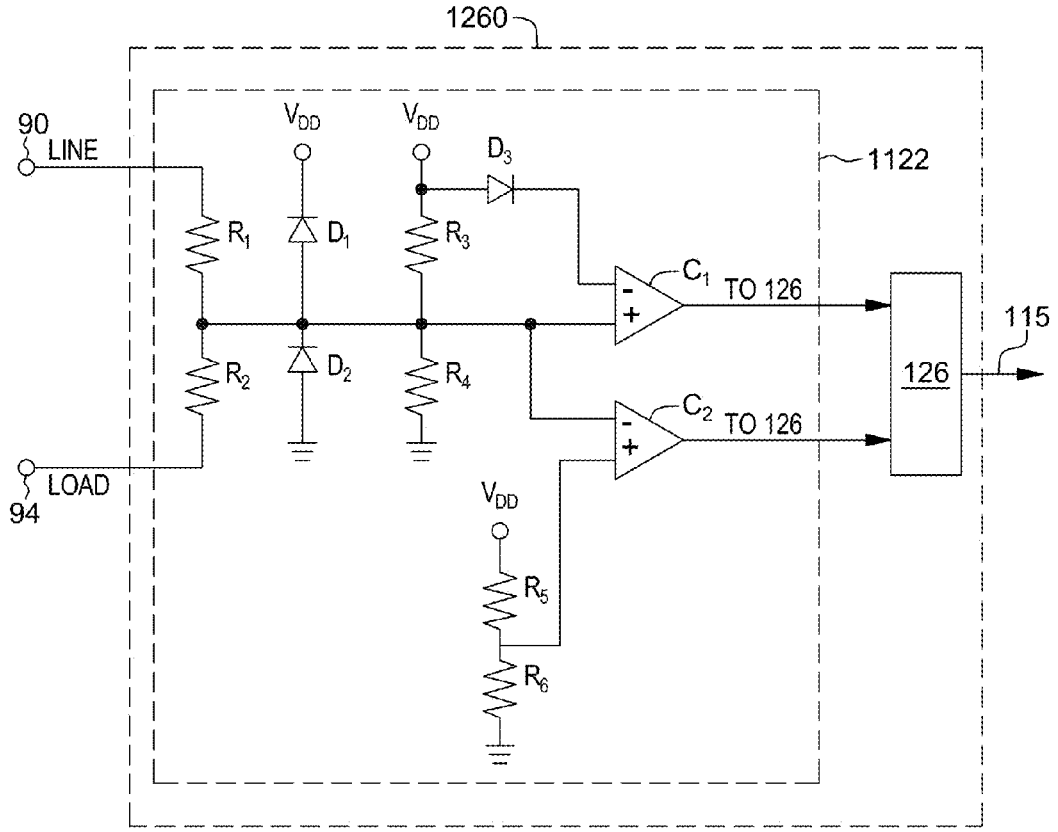
FIG. 12 is a circuit diagram of a threshold based zero crossing detector circuit having first and second comparators.

Referring to FIG. 12, another embodiment of a circuit 1122 for detecting a zero crossing of an input line voltage is shown and described. Circuit 1122 as shown in FIG. 12 can be configured in accordance with circuit 1122 as shown in FIG. 10, except that circuit 1122 as shown in FIG. 12 can include a second comparator $C_2$ and can include resistors $R_5$ and $R_6$ selected for providing a reference voltage to second comparator $C_2$. Circuit 1122 as shown in FIG. 12 can be configured to provide zero crossing detection during each half cycle (both positive and negative half cycles) of an input line voltage. The zero crossing detection can be 0V based or nonzero threshold voltage based as set forth herein. Circuit 1122 as shown in FIG. 12 can be configured so that a logic output "1" of comparator $C_1$ indicates a negative to positive half cycle zero crossing during a positive half cycle of an input line voltage and further so that a logic "1" output of comparator $C_2$ indicates a positive to negative half cycle zero crossing during a negative half cycle of an input line voltage of AC power source 88. Circuit 1122 as shown in FIG. 12 can be incorporated as part of the detector circuit 112 of FIG. 2.

Resistors $R_5$ and $R_6$ can be sized so that a comparator $C_2$ outputs a logic "1" when a input line voltage falls below 0V or a nonzero threshold negative voltage selected to be indicative of a negative half cycle zero crossing. In one aspect, signal conditioning circuitry of circuit 1122 of FIG. 12 commonly conditions inputs to both comparator $C_1$ and comparator $C_2$. Referring to the circuit of FIG. 12, a node voltage of circuit 1122 (the node connecting resistors $R_1$, $R_2$, $R_3$, $R_4$, $D_1$ and $D_2$) is commonly input to comparator $C_1$ and to comparator $C_2$. Accordingly, a low cost circuit can be provided in which common elements, e.g., elements $R_1$, $R_2$, $R_3$, $R_4$, $D_1$, $D_2$ and $D_3$ are repurposed and used for different purposes both negative to positive half cycle input line voltage zero crossing detection and positive to negative half cycle input line voltage zero crossing detection). Signal conditioning circuitry of circuit 1122 that commonly conditions inputs to both comparator $C_1$ and comparator $C_2$ includes the elements $R_1$, $R_2$, $R_3$, $R_4$, $D_1$, $D_2$ and $D_3$ in the embodiment of FIG. 12.

In one embodiment, a nonzero threshold voltage used by comparator $C_1$ of circuit 1122 as shown in FIG. 12 to detect a zero crossing can be at least 5 V. In one embodiment, a nonzero threshold voltage used by comparator $C_1$ of circuit 1122 as shown in FIG. 12 to detect a zero crossing can be at least 10 V. In one embodiment, a nonzero threshold voltage used by comparator $C_1$ of circuit 1122 as shown in FIG. 12 detect a zero crossing can be at least 20 V. In one embodiment, a nonzero threshold voltage used by comparator $C_1$ of circuit 1122 as shown in FIG. 12 can be at least 30 V. In one embodiment, a nonzero threshold voltage used by comparator $C_1$ of circuit 1122 as shown in FIG. 12 can be at least 40 V. In one embodiment, a nonzero threshold voltage used by comparator $C_1$ of circuit 1122 as shown in FIG. 12 can be at least 50 V. In one embodiment a nonzero threshold voltage used by comparator $C_1$ of circuit 1122 as shown in FIG. 12 can be at least 60 V. In one embodiment, a nonzero threshold voltage used by comparator $C_1$ of circuit 1122 as shown in FIG. 12 can be at least 70 V. In one embodiment a nonzero threshold voltage used by comparator $C_1$ of circuit 1122 as shown in FIG. 12 can be at least 80 V. In one embodiment, a nonzero threshold voltage used by comparator of circuit 1122 as shown in FIG. 12 can be at least 90 V. In one embodiment a nonzero threshold voltage used by comparator $C_1$, of circuit 1122 as shown in FIG. 12 can be at least 100 V. The nonzero threshold voltage used for zero crossing detection can be a value appreciably above 0 V without negating the ability of dimmer circuit 100 to deliver a majority of power available from AC power source 88 to load 108.

In one embodiment, a nonzero threshold voltage used by comparator $C_2$ of detector 1122 as shown in FIG. 12 to detect a zero crossing can be at least −5 V ("at least" in the context herein where negative values are referenced meaning at least that negative value or a more negative value). In one embodiment, a nonzero threshold voltage used by comparator $C_2$ of circuit 1122 as shown in FIG. 12 to detect a zero crossing can be at least −10 V. In one embodiment, a nonzero threshold voltage used by comparator $C_2$ of circuit 1122 as shown in FIG. 12 detect a zero crossing can be at least −20 V. In one embodiment, a nonzero threshold voltage used by comparator $C_2$ of circuit 1122 as shown in FIG. 12 can be at least −30 V. In one embodiment, a nonzero threshold voltage used by comparator $C_2$ of circuit 1122 as shown in FIG. 12 can be at least −40 V. In one embodiment, a nonzero threshold voltage used by comparator $C_2$ of circuit 1122 as shown in FIG. 12 can be at least −50 V. In one embodiment a nonzero threshold voltage used by comparator $C_2$ of circuit 1122 as shown in FIG. 12 can be at least −60 V. In one embodiment, a nonzero threshold voltage used by comparator $C_2$ of circuit 1122 as shown in FIG. 12 can be at least −70 V. In one embodiment, a nonzero threshold voltage used by comparator $C_2$ of circuit 1122 as shown in FIG. 12 can be at least −80 V. In one embodiment, a nonzero threshold voltage used by comparator $C_2$ of circuit 1122 as shown in FIG. 12 can be at least −90 V. In one embodiment, a nonzero threshold voltage used by comparator $C_2$ of circuit 1122 as shown in FIG. 12 can be at least −100 V. The nonzero threshold voltage used for zero crossing detection can have an absolute value appreciably above 0 V without negating the ability of dimmer circuit 100 to deliver a majority of power available from AC source 88 to load 108.

In one embodiment, circuit 1122 as shown in FIG. 12 having first and second comparators $C_1$ and $C_2$ can be used to perform both zero crossing detection and switch unlatch monitoring during each of a positive half cycle and successive negative half cycle of an input line voltage. In one embodiment, a microprocessor integrated circuit indicted by dashed line 1260 of FIG. 12 which can include controller 126 can be configured so that values of resistors $R_3$, and $R_4$ and $R_4$, and $R_5$ are programmable in such manner as to be changeable within a period of a current half cycle. Accordingly, circuit elements of a common comparator configured in accordance with circuit 1122 as shown in FIG. 12 having first and second comparators $C_1$ and $C_2$ can be repurposed and used for determining each of (a) a zero crossing detection (0V based or nonzero threshold based) and (h) one or more unlatch events pursuant to an unlatch monitoring during a positive half cycle of an input line voltage and also for determining (a) a zero crossing detection (0V based or nonzero threshold based) and (b) one or more unlatch events pursuant to an unlatch monitoring during a negative half cycle subsequent to (e.g., successive to) the positive half cycle of the input line voltage. In such an embodiment, the comparator $C_1$ can be used for positive half cycle zero crossing detection and for unlatched monitoring and the comparator $C_2$ can be used for negative half cycle zero crossing detection and unlatch monitoring.

By employing one or more of the switch firing control schemes set forth herein, predictable control over a wide range of lighting loads can be provided with economized switch firings that result in reduced power consumption and reduced, device degradation.

A switch firing control scheme as set forth herein can be provided alone or in combination with one or more other switch firing control scheme set forth herein, in one embodiment, an initial firing of switch 116 during a voltage half cycle of an AC power source (which can be performed based on a zero crossing detection which can be, e.g., 0V based or threshold based) can be performed alone or in combination with one or more additional switch firing control scheme as set forth herein, e.g., one or more of the unlatch monitoring firing control scheme, the fourth quadrant firing control scheme, or the negative half cycle zero crossing detection firing control scheme as set forth herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprise" (and any form of comprise, such as "comprises" and "comprising"), "have" (and any form of have, such as "has" and "having"), "include" (and any form of include, such as "includes" and "including"), and "contain" (and any form contain, such as "contains" and "containing") are open ended linking verbs. As a result, a method or device that "comprises", "has", "includes" or "contains" one or more steps or elements possesses those one or more steps or elements, but is not limited to possessing only those one or more steps or elements. Likewise, a step of a method or an element of a device that "comprises", "has", "includes" or "contains" one or more features possesses those one or more features, but is not limited to possessing only those one or more features. Similarly, the term "based on" herein means "based on at least" unless the context indicates otherwise and the term "responsive to" means "responsive to at least" unless the context indicates otherwise. Furthermore, a device or structure that is configured in a certain way is configured in at least that way, but may also be configured in ways that are not listed. In addition, a device or structure described as having a certain number of elements can be practiced with less than or more than the certain number of elements.

The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiment with various modifications as are suited to the particular use contemplated.

What is claimed is:

1. A dimmer circuit comprising:

a switch for controlling delivery of power of an AC power source to a load, the dimmer circuit having an input line voltage terminal and a load terminal, the load terminal coupled to the input line voltage terminal by the switch;

wherein the dimmer circuit is operative, during a conducting phase of the switch, to monitor a first voltage across the input line voltage terminal and the load terminal to detect a change in state of the switch from an ON state to an OFF state;

wherein based on the change in state being detected, the dimmer circuit is operative to cause the switch to return to an ON state;

wherein the dimmer circuit is operative, during a first half cycle of an input line voltage, to store a timing parameter, wherein the dimmer circuit is operative to utilize the timing parameter for firing the switch during a second half cycle of the input line voltage, the second half cycle being subsequent to the first half cycle; and wherein the timing parameter is a time difference between an initial firing time of the switch during the first half cycle of the input line voltage and a firing time of the switch during the first half cycle of the input line voltage based on the change in state.

2. A dimmer circuit comprising:

a switch for controlling delivery of power of an AC power source to a load, the dimmer circuit having an input line voltage terminal and a load terminal, the load terminal coupled to the input line voltage terminal by the switch;

wherein the dimmer circuit is operative, during a conducting phase of the switch, to monitor a first voltage across the input line voltage terminal and the load terminal to detect a change in state of the switch from an ON state to an OFF state;

wherein based on the change in state being detected, the dimmer circuit is operative to cause the switch to return to an ON state; and wherein the dimmer circuit is restricted from being operated to fire the switch based on the change in state being detected unless the switch has an ON state during a current half cycle of the input line voltage.

3. A dimmer circuit comprising:

a switch for controlling delivery of power of an AC power source to a load, the dimmer circuit having an input line voltage terminal and a load terminal, the load terminal coupled to the input line voltage terminal by the switch;

wherein the dimmer circuit in accordance with a first firing control scheme is operative to fire the switch at an initial firing time during a half cycle of an input line voltage; and wherein the dimmer circuit in accordance with a second firing control scheme is operative to fire the switch a variable number of times between the initial firing time and an end of the half cycle of the input line voltage, the variable number of times ranging from zero times to an integer number of times that is greater than zero, the number of times of the variable number times being based on a characteristic of the load.

4. The dimmer circuit of claim 3, wherein the dimmer circuit in accordance with a third firing control scheme is operative to fire the switch at a subsequent firing time during the half cycle of the input line voltage, the subsequent firing time being subsequent to the initial firing time.

5. The dimmer circuit of claim 4, wherein the dimmer circuit in accordance with the third firing control scheme is operative so that the subsequent firing time is within a fourth quadrant of the half cycle of the input line voltage.

6. The dimmer circuit of claim 3, wherein the dimmer circuit is restricted from firing the switch in accordance with the first firing control scheme if the switch has previously initially fired during a current half cycle of the input line voltage.

7. The dimmer circuit of claim 3, wherein the dimmer circuit is restricted from firing in accordance with the second firing control scheme unless the dimmer circuit was previous initially fired during a current half cycle of the input line voltage.

8. The dimmer circuit of claim 3, wherein the dimmer circuit includes a first comparator for use in detecting a zero crossing at a positive half cycle of the input line voltage, and a second comparator for use in detecting a zero crossing at a negative half cycle of the input line voltage.

* * * * *